US010168093B2

(12) United States Patent
Eom et al.

(10) Patent No.: US 10,168,093 B2
(45) Date of Patent: Jan. 1, 2019

(54) DOOR GUIDE ASSEMBLY AND REFRIGERATOR HAVING THE SAME

(71) Applicant: SAMSUNG ELECTRONICS CO., LTD., Suwon-si, Gyeonggi-do (KR)

(72) Inventors: Tae-In Eom, Hwaseong-si (KR); Nam Soo Park, Suwon-si (KR); Hyung Kwen Ham, Seoul (KR); Seon Ju Lee, Seoul (KR); Young Seok Lee, Seoul (KR); Bok Hyun Jang, Suwon-si (KR); Simon Ireland, Seongnam-si (KR); June Hyuck Choi, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/958,479

(22) Filed: Apr. 20, 2018

(65) Prior Publication Data

US 2018/0238604 A1 Aug. 23, 2018

Related U.S. Application Data

(63) Continuation of application No. 15/367,910, filed on Dec. 2, 2016, now Pat. No. 9,976,793.

(30) Foreign Application Priority Data

Dec. 3, 2015 (KR) ..... 10-2015-0171378

(51) Int. Cl.
*F25D 23/02* (2006.01)
*E05C 19/16* (2006.01)
(Continued)

(52) U.S. Cl.
CPC ..... *F25D 23/025* (2013.01); *E05C 19/161* (2013.01); *F25D 11/02* (2013.01);
(Continued)

(58) Field of Classification Search
CPC ..... F25D 23/025; F25D 23/04; F25D 25/04; F25D 11/02; F25D 2323/023; F25D 2400/06; E05C 19/161
See application file for complete search history.

(56) References Cited

U.S. PATENT DOCUMENTS 3,610,174 A 10/1971 Kesling
2010/0176702 A1 7/2010 Kim
(Continued)

FOREIGN PATENT DOCUMENTS

DE 102008014885 9/2009
EP 2489967 A1 8/2012
(Continued)

OTHER PUBLICATIONS

Extended European Search Report dated May 10, 2017 in corresponding European Patent Application No. 16201522.6.
(Continued)

*Primary Examiner* — Hanh V Tran
(74) *Attorney, Agent, or Firm* — Staas & Halsey LLP

(57) ABSTRACT

An integral door guide assembly is removably coupled in an opening of a door of a refrigerator and has an adjustable height. The refrigerator includes a first door rotatably connected to a front surface of a main body, and having an opening in which a plurality of door guide assemblies can be arranged, and a second door rotatably connected to a front surface of the first door. The door guide assembly includes a door guide, a guide removably fixed on both side walls of the opening, a moving unit removably coupled with both side walls of the door guide, guided by the guide to move in an up-down direction, a stopper coupled with the guide, and caught by or released from the catching projections to adjust a position of the moving unit and a latch configured to fix the stopper released from the catching projections.

12 Claims, 39 Drawing Sheets

(51) Int. Cl.

| | |
|---|---|
| ***F25D 11/02*** | (2006.01) |
| ***F25D 23/04*** | (2006.01) |
| *F25D 25/04* | (2006.01) |

(52) U.S. Cl.

CPC ..... *F25D 23/04* (2013.01); *F25D 25/04* (2013.01); *F25D 2323/023* (2013.01); *F25D 2400/06* (2013.01)

(56) References Cited

U.S. PATENT DOCUMENTS

| | | | |
|---|---|---|---|
| 2010/0301723 | A1 | 12/2010 | Seo |
| 2012/0018435 | A1 | 1/2012 | Kim |
| 2012/0293056 | A1 | 11/2012 | Kim |
| 2013/0119845 | A1 | 5/2013 | Seo et al. |
| 2014/0042886 | A1 | 2/2014 | Baldo |
| 2014/0062283 | A1 | 3/2014 | Baldo |
| 2014/0366569 | A1 | 12/2014 | Babinski |
| 2015/0123532 | A1 | 5/2015 | Kwon |
| 2015/0330700 | A1 | 11/2015 | Celik |
| 2016/0003520 | A1 | 1/2016 | Wang et al. |
| 2016/0010914 | A1 | 1/2016 | Kong |

FOREIGN PATENT DOCUMENTS

| | | | |
|---|---|---|---|
| EP | 2 843 333 | | 3/2015 |
| JP | 2010-185628 | | 8/2010 |
| JP | 2012247153 | | 12/2012 |
| JP | 2013053843 | | 3/2013 |
| KR | 10-2010-0138098 | | 12/2010 |
| KR | 10-2011-0089792 | | 8/2011 |
| KR | 10-2012-0009651 | | 2/2012 |
| KR | 10-2013-0036673 | | 4/2013 |
| KR | 10-2013-0055174 | | 5/2013 |
| KR | 10-2015-0106231 | | 9/2015 |
| WO | 2015/117564 | A1 | 8/2015 |
| WO | 2015/172446 | A1 | 11/2015 |

OTHER PUBLICATIONS

European Communication dated Dec. 12, 2017 in European Patent Application No. 16201522.6.

U.S. Notice of Allowance dated Jan. 22, 2018 in U.S. Appl. No. 15/367,910.

U.S. Office Action dated Nov. 14, 2017 in U.S. Appl. No. 15/367,910.

U.S. Appl. No. 15/367,910, filed Dec. 2, 2016, Tae-In Eom, et al., Samsung Electronics Co., Ltd.

DOOR GUIDE ASSEMBLY AND REFRIGERATOR HAVING THE SAME

CROSS-REFERENCE TO RELATED APPLICATIONS

This application is a continuation application of U.S. patent application Ser. No. 15/367,910 filed on Dec. 2, 2016, which claims the priority benefit of Korean Patent Application No. 10-2015-0171378, filed on Dec. 3, 2015, in the Korean Intellectual Property Office, the disclosures of which are incorporated herein by reference in their entirety.

BACKGROUND

1. Field

Embodiments of the disclosure relate to a door guide assembly capable of adjusting the height, and a refrigerator having the same.

2. Description of the Related Art

In general, a refrigerator is a home appliance including a storage chamber to store food therein and a cool-air supply apparatus to supply cool air to the storage chamber, to keep food fresh for a long time.

The inside temperature of the storage chamber is maintained within a specific temperature range required to store food fresh.

The front part of the storage chamber of the refrigerator opens, and the open front part of the storage chamber is closed by a door at ordinary time in order to maintain the inside temperature of the storage chamber.

The storage chamber is partitioned into a freezing chamber which is the left storage chamber and a refrigerating chamber which is the right storage chamber by a partition wall, and the freezing chamber and the refrigerating chamber are opened or closed by a freezing chamber door and a refrigerating chamber door, respectively.

The refrigerating chamber door is rotatably connected to the front surface of a main body to open or close the storage chamber, and includes a first door having an opening in which a plurality of door guides are arranged, and a second door rotatably connected to the front surface of the first door to open or close the opening.

If the door guides arranged in the opening are fixed in the opening, the heights of the door guides cannot be adjusted according to the heights of food stored in the door guides.

SUMMARY

Therefore, it is an aspect of the disclosure to provide an integral door guide assembly that can be removably coupled in an opening of a door and can adjust the height, and a refrigerator having the door guide assembly.

Additional aspects and/or advantages of the disclosure will be set forth in part in the description which follows and, in part, will be apparent from the description, or may be learned by practice of the disclosure.

In accordance with an aspect of the disclosure, a refrigerator may include a main body having a storage chamber, a first door rotatably connected to the front surface of the main body, configured to open or close the storage chamber, and having an opening in which a plurality of door guide assemblies are arranged, and a second door rotatably connected to the front surface of the first door, and configured to open or close the opening. The door guide assembly may include a door guide configured to store food therein, a guide removably fixed on both side walls of the opening, a moving unit removably coupled with both side walls of the door guide, guided by the guide to move in an up-down direction, and including a catching portion having a plurality of catching projections arranged in the up-down direction, a stopper coupled with the guide, and caught by or released from the catching projections to adjust a position of the moving unit and a latch configured to fix the stopper escaped from the catching projections, if the moving unit moves up to the top of the guide.

An accommodating groove which the moving unit may be accommodated in and coupled with is formed in both side walls of the door guide, a plurality of coupling grooves with which the moving unit is removably coupled are formed in the accommodating groove, and a plurality of coupling protrusions which are removably coupled with the plurality of coupling grooves are formed in the moving unit.

A plurality of coupling protrusions which may be removably coupled with the plurality of coupling grooves are formed in the moving unit.

A protrusion at which the guide may be removably fixed is formed on both side walls of the opening, and the guide may include a fixing portion fixed at the protrusion.

The guide may include a guide rail configured to guide the moving unit to move in the up-down direction, and a guide portion moving along the guide rail is formed in the moving unit.

The guide may include a stopper coupling portion with which the stopper is rotatably coupled, a latch coupling groove with which the latch is rotatably coupled, wherein the latch coupling groove is formed in a surface of the guide which is opposite to the other surface on which the stopper coupling portion is formed, and a through hole which the stopper penetrates to contact the latch.

The stopper may include a coupling hole rotatably coupled with the stopper coupling portion, a stopper protrusion penetrating the through hole to contact the latch, a catching protrusion caught by or released from the catching projections, and a torsion spring coupling portion coupled with a torsion spring for elastically supporting the stopper such that the catching protrusion rotates in a direction toward the catching projections with respect to the coupling hole.

The through hole may have a shape for guiding the stopper protrusion rotating with respect to the coupling hole when the stopper rotates on the coupling groove.

Below the plurality of catching projections, a rotation guide portion may be disposed to guide the stopper to rotate on the coupling hole in the opposite direction of the direction toward the catching projections.

The latch may include a coupling portion rotatably coupled with the latch coupling groove, a rotation preventing portion configured to fix the stopper protrusion to prevent the stopper from rotating so as to prevent the catching protrusion from being caught by the catching projections, a first support configured to support a spring for elastically supporting the latch in a direction in which the rotation preventing portion rotates to contact the stopper protrusion, and a contact surface contacting the moving unit when the door guide moves upward and then again moves downward so that the latch rotates on the coupling portion.

If the door guide moves upward, the guide portion moves upward along the guide rail so that the moving unit may move upward together with the door guide, and the door guide moved upward is caught by or released from the plurality of catching projections so that the position of the door guide may be adjusted by the stopper.

If the door guide moves upward to escape from the position adjusted by the plurality of catching projections, the stopper is rotated on the coupling hole by the rotation guide portion, in the opposite direction of a direction in which the catching protrusion moves toward the catching projections, so that the stopper protrusion is fixed at the rotation preventing portion, and if the stopper protrusion is fixed at the rotation preventing portion, the stopper may be prevented from rotating on the coupling hole in the direction toward the catching projections.

If the door guide moves downward in the state in which the stopper is fixed to rotate no longer, the guide portion moves downward along the guide rail so that the moving unit may move downward together with the door guide.

If the door guide moves downward so that the moving unit contacts the contact surface, the latch rotates on the coupling portion in a direction in which the spring is compressed, so that the stopper protrusion may be released from the rotation preventing portion.

If the stopper protrusion is released, the stopper is rotated on the coupling hole by the torsion spring in the direction toward the catching projections so that the catching protrusion may be caught by the catching projections.

In accordance with another aspect of the disclosure, a refrigerator may include a main body having a storage chamber, a first door rotatably connected to the front surface of the main body, configured to open or close the storage chamber, and having an opening in which a plurality of door guide assemblies are arranged and a second door rotatably connected to the front surface of the first door, and configured to open or close the opening. The door guide assembly may include a guide removably fixed on both side walls of the opening, and including a catching portion having a plurality of catching projections arranged in an up-down direction, a door guide including an accommodating groove to accommodate the guide at both side walls, and guided by the guide to move in the up-down direction, a stopper installed in the inside of the accommodating groove, and caught by or released from the catching projections to adjust a position of the door guide and a fixing rib formed in the guide, and configured to fix the stopper escaped from the catching projections, if the door guide moves up to the top of the guide.

The guide may include a guide rail configured to guide the door guide to move in the up-down direction, and a fixing portion removably fixed at a protrusion formed on both side walls of the opening, and in the inside of the accommodating groove, a guide portion guided along the guide rail, and a pair of stopper coupling portions with which the stopper is rotatably coupled are disposed.

The stopper is provided as a pair of stoppers including a first stopper and a second stopper, the first stopper and the second stopper may include a first coupling hole and a second coupling hole rotatably coupled with the stopper coupling portions, and a pair of catching protrusions caught by or released from the plurality of catching projections, and a stopper protrusion may be formed adjacent to the catching protrusion of at least one of the first stopper and the second stopper in such a way to protrude toward the guide.

On the outer surfaces of the first coupling hole and the second coupling hole, a first gear portion and a second gear portion are formed in such a way to be interlocked with each other, and when the first stopper rotates on the first coupling hole, the second stopper may rotate on the second coupling hole in the opposite direction of a direction in which the first stopper rotates.

In accordance with still another aspect of the disclosure, a door guide assembly may be disposed in a door rotatably connected to the front surface of a main body having a storage chamber, and may be configured to open or close the storage chamber. The door guide assembly is movable in an up-down direction, and the door guide assembly may include a door guide configured to store food therein a guide removably fixed at the door to correspond to both side walls of the door guide, a moving unit removably coupled with both side walls of the door guide, guided by the guide to move in the up-down direction, and including a catching portion having a plurality of catching projections arranged in the up-down direction, a stopper coupled with the guide, and caught by or released from the catching projections to adjust a position of the moving unit and a latch configured to fix the stopper escaped from the catching projections, if the moving unit moves up to the top of the guide.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
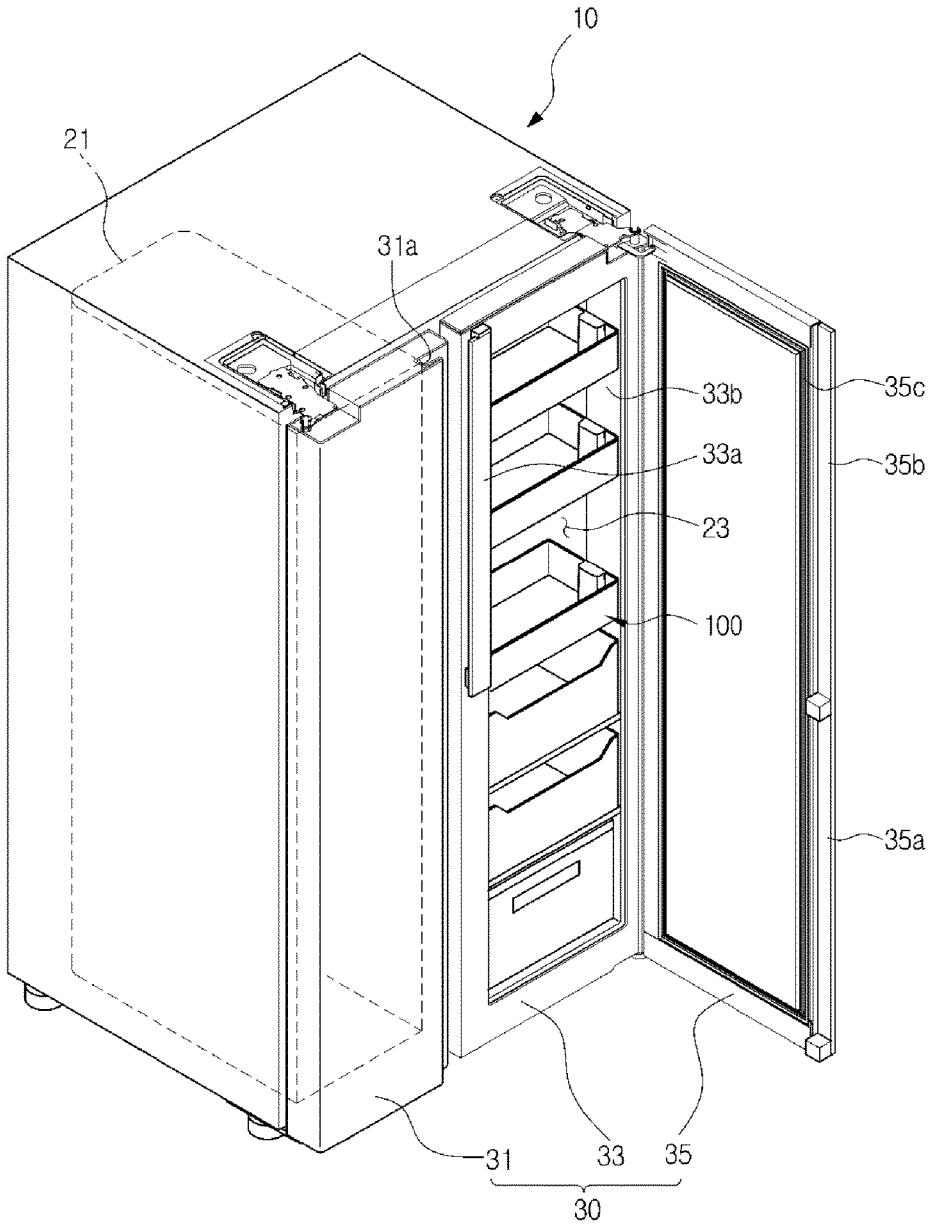
FIG. 1 shows a refrigerator according to an embodiment of the disclosure when a second door opens.

Reference will now be made in detail to example embodiments which are illustrated in the accompanying drawings, wherein like reference numerals refer to like elements throughout. The embodiments are described below to explain the disclosure by referring to the figures.

Hereinafter, embodiments of the disclosure will be described in detail, with reference to the accompanying drawings.

Figure 2:
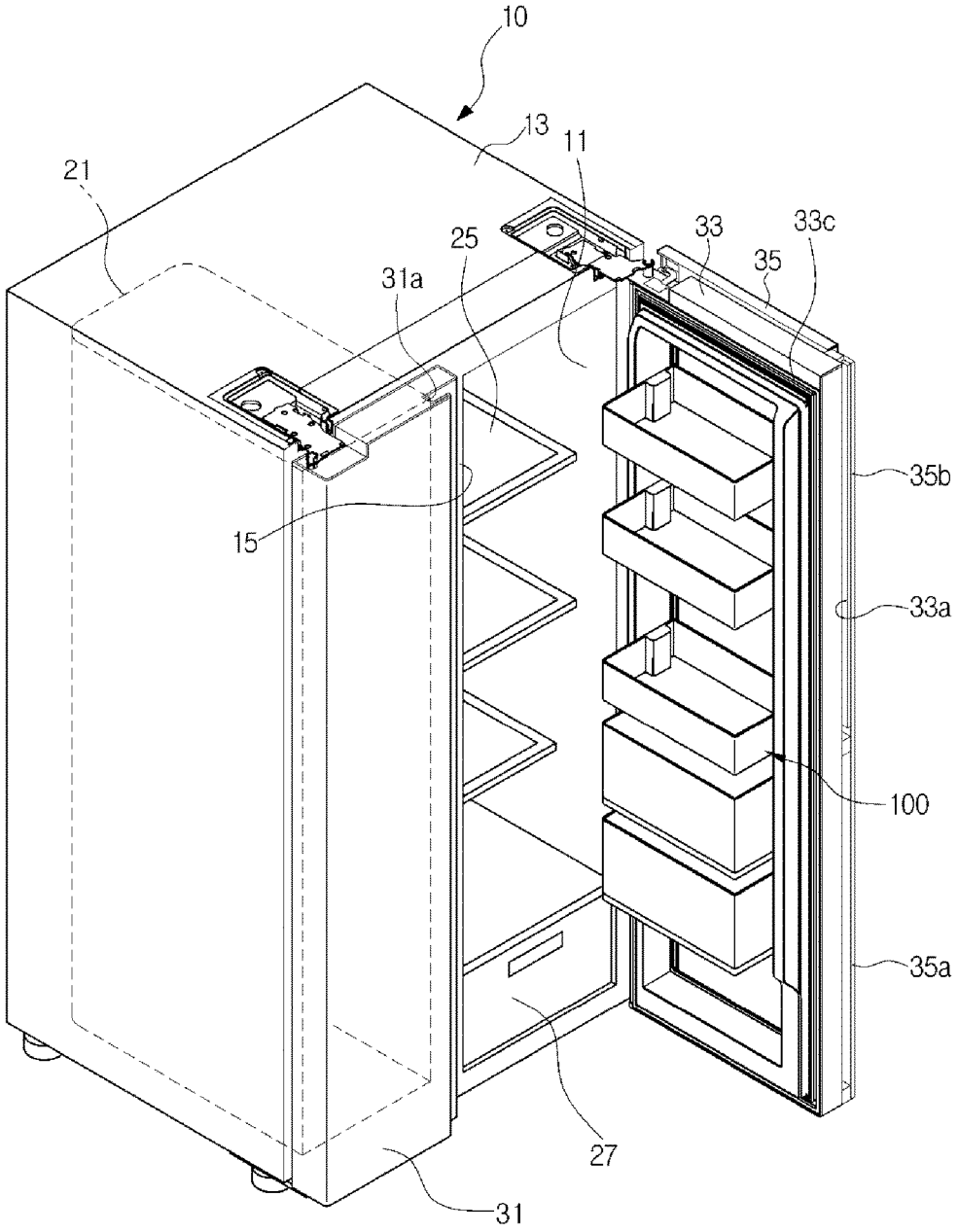
FIG. 2 shows the refrigerator according to the embodiment of the disclosure when a first door and the second door open together.

FIG. 1 shows a refrigerator according to an embodiment of the disclosure when a second door opens, and FIG. 2 shows the refrigerator according to the embodiment of the disclosure when a first door and the second door open together.

As shown in FIGS. 1 and 2, the refrigerator may include a main body 10, a storage chamber 20 formed in the inside of the main body 10, wherein the front part of the storage chamber 20 opens, a door 30 configured to open or close the storage chamber 20, and a cool-air supply apparatus configured to supply cool air to the storage chamber 20.

The main body 10 may have a box-like shape, and include an inner cabinet 11 forming the storage chamber 20, an outer cabinet 13 coupled with the outer side of the inner cabinet 11 and forming the outer appearance of the refrigerator, and an insulator (not shown) provided between the inner cabinet 11 and the outer cabinet 13.

The inner cabinet 11 may be made of a resin material, and the outer cabinet 13 may be made of a steel material.

The cool-air supply apparatus may include a compressor (not shown), a condenser (not shown), an expansion valve (not shown), and an evaporator (not shown), and circulate refrigerants to generate cool air using evaporation latent heat.

The storage chamber 20 may be partitioned into a freezing chamber 21 which is the left storage chamber and a refrigerating chamber 23 which is the right storage chamber, by a vertical partition wall 15.

However, the positions of the freezing chamber 21 and the refrigerating chamber 23 may change. In the refrigerating chamber 23, a shelf 25 to put food thereon, and a storage box 27 to store food therein may be provided.

The storage chamber 20 whose front part opens may be opened or closed by the door 30. The door 30 may include a freezing chamber door 31 for opening or closing the freezing chamber 21, and a plurality of refrigerating chamber doors 33 and 35 for opening or closing the refrigerating chamber 23.

The freezing chamber door 31 may be rotatably connected to the front surface of the main body 10, and may be rotatable in a left-right direction with respect to a vertical rotation axis.

The refrigerating chamber doors 33 and 35 may include a first door 33 rotatably connected to the front surface of the main body 10, and a second door 35 rotatably connected to the front surface of the first door 33.

The first door 33 may include an opening 33*b* that is a little smaller than the size of the refrigerating chamber 23, and in the opening 33*b*, a plurality of door guide assemblies 100 may be arranged.

The second door 35 may be rotatably connected to the front surface of the first door 33 to open or close the opening 33*b* provided in the first door 33.

In the freezing chamber door 31, a handle 31*a* may be provided to enable a user to grip it with his/her hand to open or close the freezing chamber door 31.

In the first door 33 and the second door 35, a first handle 33*a* and a second handle 35*a* may be respectively provided in such a way to be vertically disposed in a line, wherein the first handle 33*a* may be located higher than the second handle 35*a*.

Above the second handle 35*a*, a handle cover 35*b* for covering the first handle 33*a* may extend so that the first handle 33*a* may be not exposed to the outside as it is covered by the handle cover 35*b* in the front view.

The operations of the first door 33 (also, referred to as an inside door 33) and the second door 35 (also, referred to as an outside door 35) will be described below. As shown in FIG. 1, a user may open the second door 35, and approach at least one door guide assembly 100 to take food out of the at least one door guide assembly 100 or to put food into the at least one door guide assembly 100.

When only the second door 35 opens, a smaller amount of cool air may leak than when the first door 33 opens.

When the user takes/puts food out of/into the door guide assembly 100 in the state in which the first door 33 closes and only the second door 35 opens, the user may take/put various kinds of food out of/into the door guide assembly 100. Such various kinds of food may have different heights.

Accordingly, it is necessary to adjust the height of the door guide assembly 100 according to the height of food that is taken out of or put into the door guide assembly 100. This operation will be described later.

As shown in FIG. 2, the user may open the first door 33, and approach the inside of the refrigerating chamber 23 to take/put food out of/on the shelf 25, or approach at least one door guide assembly 100 to take/put food out of/into the at least one door guide assembly 100.

As such, the refrigerator according to the embodiment of the disclosure may allow a user to take/put food in various ways according to the user's need, while minimizing leakage of cool air.

Meanwhile, on the rear surface of the first door 33, a first gasket 33*c* may be provided to maintain sealing between the first door 33 and the outer cabinet 13 of the main body 10, and the first gasket 33*c* may be made of a rubber material.

Also, the first gasket 33*c* may include a magnet (not shown) therein to attract the outer cabinet 13 made of a steel material so that the inside door 33 can be maintained in a closed state.

Also, on the rear surface of the second door 35, a second gasket 35*c* may be provided to maintain sealing between the second door 35 and the first door 33, and the second gasket 35*c* may be made of a rubber material.

Also, the second gasket 35*c* may include a magnet (not shown) therein to attract the front surface of the first door 33 made of a steel material so that the second door 35 can be maintained in a closed state.

As such, in the refrigerator according to the embodiment of the disclosure, the first door 33 and the second door 35 can be maintained in a closed state at ordinary time by a magnetic force of the magnet.

Hereinafter, the door guide assembly 100 disposed in the opening 33*b* of the first door 33 will be described in detail with reference to FIGS. 3 to 8.

Figure 3:
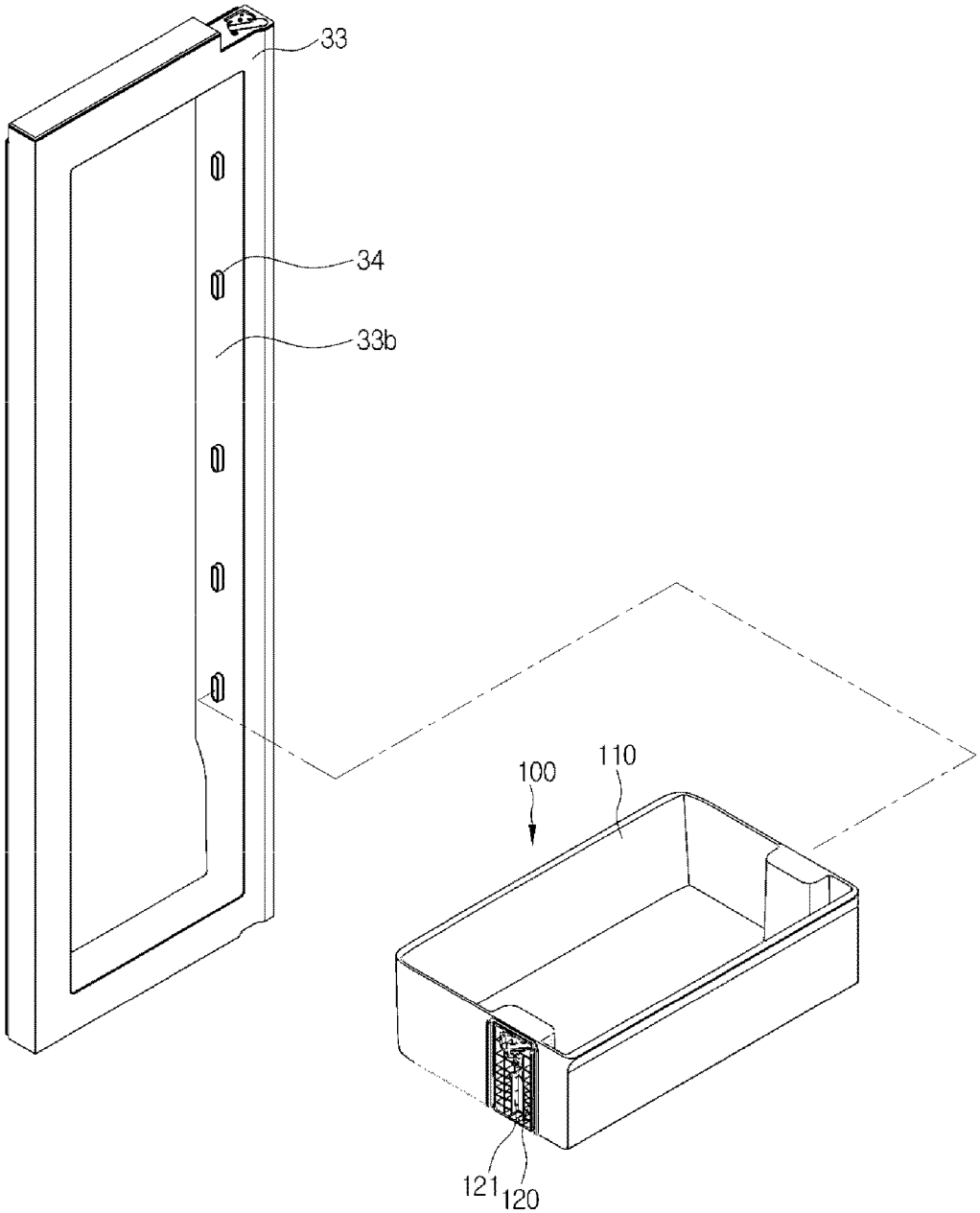
FIG. 3 shows a state when a door guide assembly according to an embodiment of the disclosure is coupled in an opening of a first door.
Figure 4:
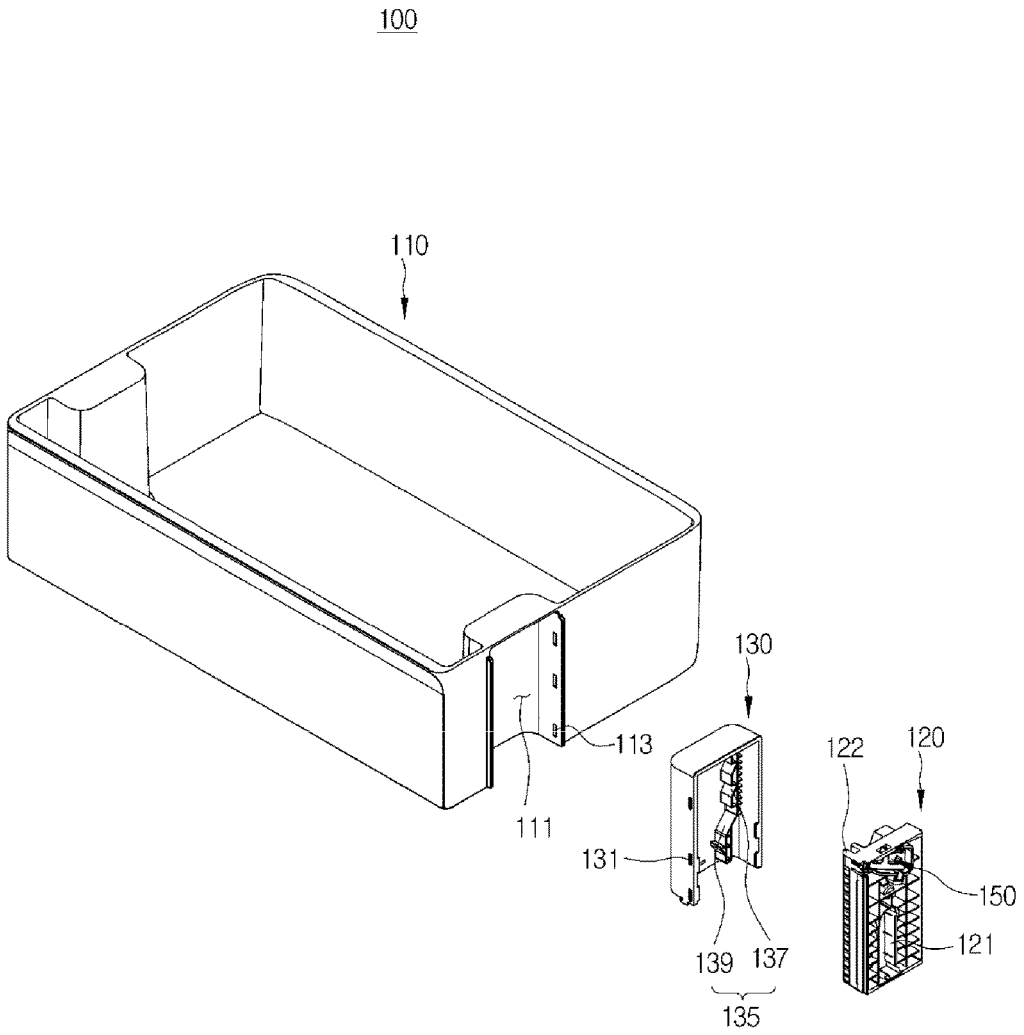
FIG. 4 is an exploded perspective view of the door guide assembly according to the embodiment of the disclosure.
Figure 5:
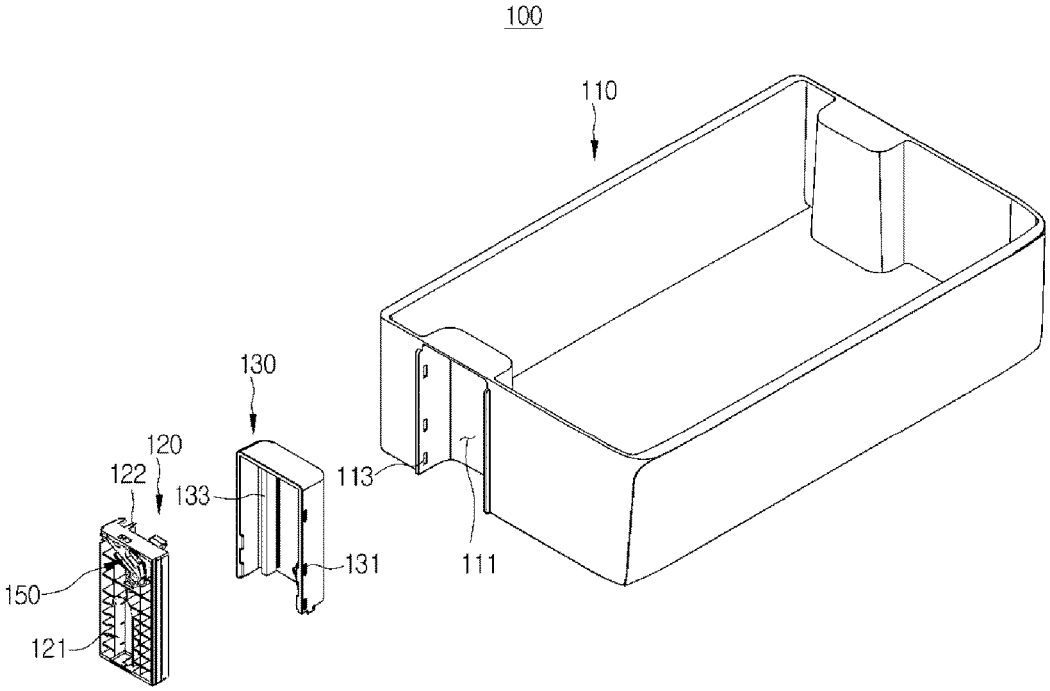
FIG. 5 shows the door guide assembly of FIG. 4 when it is seen from a different view angle.
Figure 6:
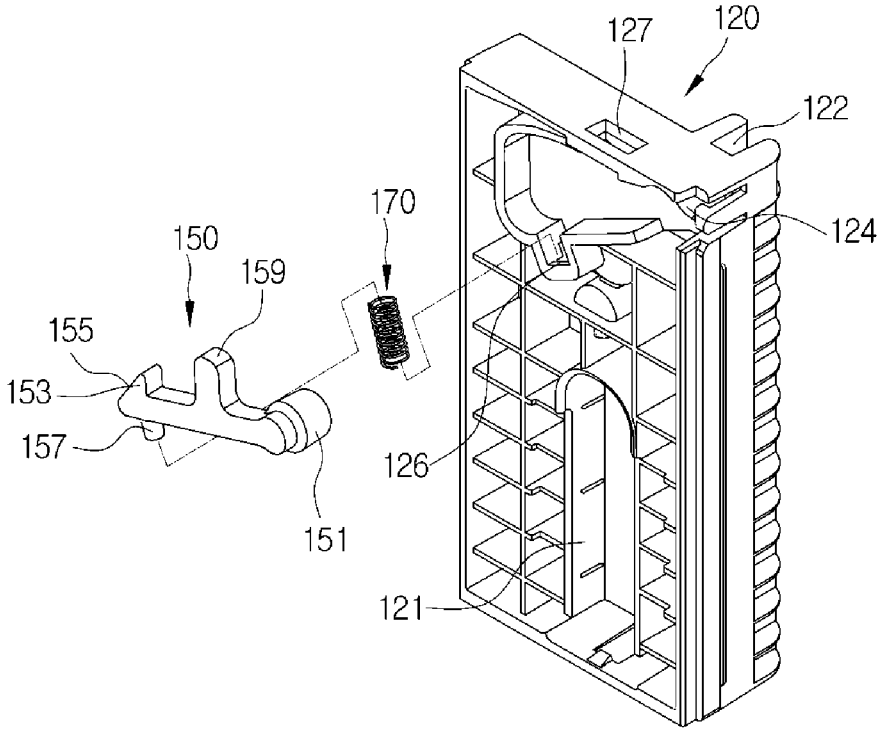
FIG. 6 shows a state when a latch is coupled with a guide according to an embodiment of the disclosure.
Figure 7:
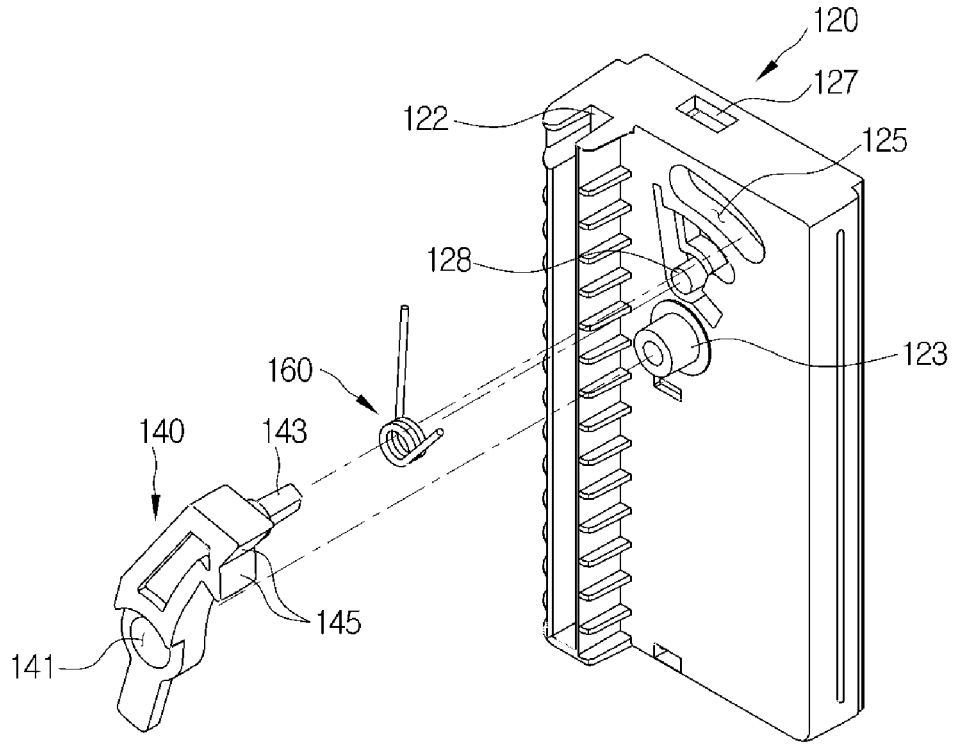
FIG. 7 shows a state when a stopper is coupled with the guide according to the embodiment of the disclosure.
Figure 8:
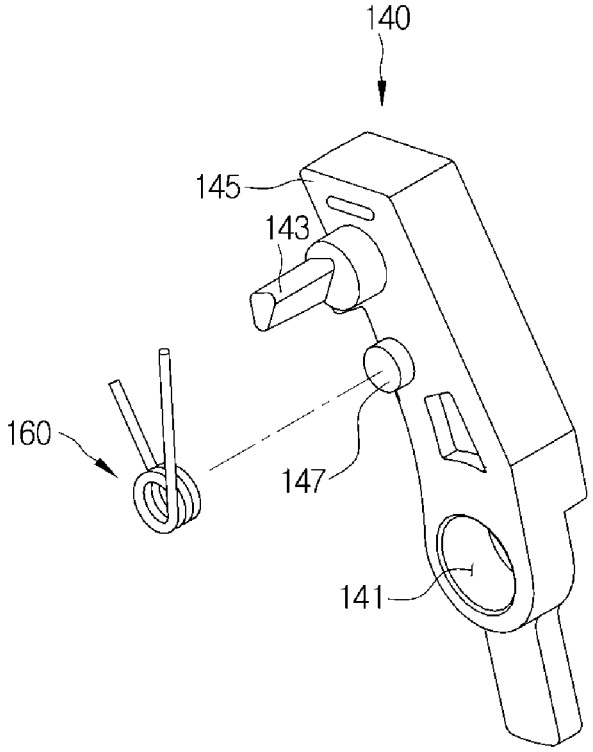
FIG. 8 shows a state when a torsion spring is coupled with a stopper according to an embodiment of the disclosure.

FIG. 3 shows a state when a door guide assembly according to an embodiment of the disclosure is coupled in an opening of a first door, FIG. 4 is an exploded perspective view of the door guide assembly according to the embodiment of the disclosure, FIG. 5 shows the door guide assembly of FIG. 4 when it is seen from a different view angle, FIG. 6 shows a state when a latch is coupled with a guide according to an embodiment of the disclosure, FIG. 7 shows a state when a stopper is coupled with the guide according to the embodiment of the disclosure, and FIG. 8 shows a state when a torsion spring is coupled with a stopper according to an embodiment of the disclosure As shown in FIG. 3, the door guide assembly 100 may be implemented as one body such that it can adjust the height according to the height of food stored therein, and may be removably fixed at a protrusion 34 formed on both side walls of the opening 33*b* of the first door 33.

As shown in FIGS. 4 to 8, the door guide assembly 100 may include a door guide 110 to store food therein, a guide 120 removably fixed on both side walls of the opening 33*b* of the first door 33, a moving unit 130 removably coupled with both side walls of the door guide 110 and guided by the guide 120 to move in an up-down direction, a stopper 140 coupled with the guide 120 and configured to adjust the position of the moving unit 130 in the up-down direction, and a latch 150 configured to fix the stopper 140 if the moving unit 130 moves up to the top of the guide 120.

The door guide 110 may be in the shape of a box whose upper portion opens to store food therein. In the outer surfaces of both side walls of the door guide 110, an accommodating groove 111 may be formed.

The moving unit 130 may be accommodated in the accommodating groove 111, and a plurality of coupling grooves 113 may be formed in the accommodating groove 111 so that the moving unit 130 is removably coupled with the door guide 110.

The guide 120 may be removably fixed on both side walls of the opening 33*b* of the first door 33 to guide the moving unit 130 coupled with the door guide 110 to move in the up-down direction.

The guide 120 may include a fixing portion 121 removably fixed at the protrusion 34 formed on both side walls of the opening 33*b*, a guide rail 122 configured to guide the moving unit 130 to move in the up-down direction, a stopper coupling portion 123 with which the stopper 140 is rotatably coupled, a latch coupling groove 124 with which the latch 150 is rotatably coupled, a through hole 125 which the stopper 140 penetrates to contact the latch 150, a second support 126 by which one end of a spring 150 for elastically supporting the latch 150 is supported, an opening 127 to allow a contact surface 159 of the latch 150 to contact the moving unit 130, and a torsion spring fixing portion 128 at which the torsion spring 160 is fixed.

The fixing portion 121 may have a shape corresponding to the protrusion 34 formed on both side walls of the opening 33*b*, and removably fix the guide 120 at the protrusion 34.

A guide portion 133 formed in the moving unit 130 may be accommodated in the guide rail 122 in such a way to be movable in the up-down direction, so that the door guide 110 coupled with the moving unit 130 can move in the up-down direction.

The stopper coupling portion 123 may protrude in the shape of a cylinder from one surface of the guide 120 so that the stopper 140 can be rotatably coupled with the stopper coupling portion 123.

The latch coupling groove 124 may be formed in the shape of a circular groove in the other surface of the guide 120, which is opposite to the surface on which the stopper coupling portion 123 of the guide 120 is formed, so that the latch 150 can be rotably coupled with the latch coupling groove 124.

The through hole 125 may penetrate the guide 120 such that the stopper 140 and the latch 150 respectively coupled with both surfaces of the guide 120 can contact each other, more specifically, such that a stopper protrusion 143 of the stopper 140 can contact the latch 150 through the through hole 125.

The through hole 125 may have a shape for guiding the stopper protrusion 143 rotating with respect to a coupling hole 141 when the stopper 140 rotates on the coupling groove 141 which will be described later.

The second support 126 may support one end of the spring 170 for elastically supporting the latch 150, and the other end of the spring 170 may be supported on a first support 157 of the latch 150.

Since the second support 126 of supporting one end of the spring 170 is formed in the guide 120, and the first support 157 of supporting the other end of the spring 170 is formed in the latch 150 rotatably coupled with the guide 120, the latch 150 may rotate on a coupling portion 151, in a direction in which the spring 170 is compressed, or in the opposite direction of the direction in which the spring 170 is compressed, by the elastic force of the spring 170.

The moving unit 130 may be accommodated in the accommodating groove 111 formed in both side walls of the door guide 110 to be coupled with the door guide 110. The moving unit 130 may be guided by the guide 120 to move in the up-down direction so that the door guide 100 coupled with the moving unit 130 can move in the up-down direction.

The moving unit 130 may include a plurality of coupling protrusions 131 located to correspond to the plurality of coupling holes 113 formed in the accommodating groove 111 formed in both side walls of the door guide 110, and removably coupled with the plurality of coupling holes 113, the guide portion 133 guided along the guide rail 122, and a catching portion 135 having a plurality of catching projections 137 arranged in the up-down direction.

A catching protrusion 145 of the stopper 140 may be caught by or released from the plurality of catching projections 137, so that the height of the door guide 110 can be adjusted according to a position at which the catching protrusion 145 is caught by the plurality of catching projections.

Below the plurality of catching projections 137, a rotation guide portion 139 may be disposed to guide the stopper 140 to rotate in the opposite direction of the direction toward the catching projections 137 with respect to the coupling hole 141.

The stopper 140 may be rotatably coupled with the stopper coupling portion 123 of the guide 120 to be caught by or released from the plurality of catching projections 137 formed in the moving unit 130, so as to adjust the height of the door guide 110.

The stopper 140 may include the coupling hole 141 rotatably coupled with the stopper coupling portion 123 of the guide 120, the stopper protrusion 143 penetrating the through hole 125 formed in the guide 120 to contact the latch 150, the catching protrusion 145 caught by or released from the plurality of catching projections 137, and a torsion spring coupling portion 147 coupled with the torsion spring 160 for elastically supporting the stopper 140 such that the catching protrusion 145 rotates in a direction toward the catching projections 137 with respect to the coupling hole 141.

The coupling hole 141 may be in the shape of a circular hole corresponding to the stopper coupling portion 123 so as to be rotatably coupled with the stopper coupling portion 123.

The stopper protrusion 143 may penetrate the guide 120 through the through hole 125 to contact the latch 150. If the moving unit 130 moves up to the top of the guide 120 so that the catching protrusion 145 of the stopper 140 escapes from the catching projections 137, the stopper protrusion 143 may be caught by the latch 150 to prevent the stopper 140 from rotating.

The catching protrusion 145 may be formed at the other end of the stopper 140 that is opposite to the end of the stopper 140 at which the coupling hole 141 coupled with the stopper coupling portion 123 is formed. If the stopper 140 rotates on the coupling hole 141, the catching protrusion 145 may be caught by or released from the plurality of catching projections 137 so as to adjust the height of the door guide 110.

The torsion spring 160 may be coupled with the torsion spring coupling portion 147, and transfer an elastic force to the stopper 140 so that the catching protrusion 145 of the stopper 140 rotates in the direction toward the plurality of catching projections 137 with respect to the coupling hole 141.

Accordingly, the catching protrusion 145 of the stopper 140 may be in contact with the catching portion 135 including the plurality of catching projections 137, and if a user moves the door guide 110 upward, the catching protrusion 145 may be caught by or released from the plurality of catching projections 137 by a force applied by the user.

If the moving unit 130 moves up to the top of the guide 120, the catching protrusion 145 of the stopper 140 may escape from the catching projections 137, and the latch 150 may catch the stopper protrusion 143 of the stopper 140 to fix the stopper 140 so that the stopper 140 rotates no longer.

The latch 150 may include the coupling portion 151 rotatably coupled with the latch coupling groove 124 of the guide 120, a rotation preventing portion 153 catching the stopper protrusion 143 of the stopper 140 to prevent the stopper 140 from rotating, a first support 157 on which the spring 170 is supported, and the contact surface 159 contacting the moving unit 130 when the door guide 110 moves upward and then again moves downward.

The rotation preventing portion 153 may be formed at the other end of the latch 150 that is opposite to the end of the latch 150 at which the coupling portion 151 is formed. Since the latch 150 is rotated on the coupling portion 151 by the spring 170 to move the rotation preventing portion 153 upward, the rotation preventing portion 153 may be in contact with the stopper protrusion 143 of the stopper 140, and the surface of the rotation preventing portion 153 contacting the stopper protrusion 143 may be formed as an inclined surface 155.

If the door guide 110 moves up to the top of the guide 120 while the stopper protrusion 143 is in contact with the rotation preventing portion 153, the catching protrusion 145 may escape from the plurality of catching projections 145, and the stopper 140 may be guided by the rotation guide portion 139 to rotate on the coupling hole 141 in the opposite direction of the direction in which the catching protrusion 145 moves toward the catching portion 135.

If the stopper 140 rotates on the coupling hole 141 in the opposite direction of the direction in which the catching protrusion 145 moves toward the catching portion 135, the stopper protrusion 143 may climb over the inclined surface 155 of the rotation preventing portion 153, while pressing the rotation preventing portion 153 so that the latch 150 rotates on the coupling portion 151 such that the rotation preventing portion 153 rotates downward.

If the stopper protrusion 143 climbs over the inclined surface 155 of the rotation preventing portion 153, the latch 150 may be rotated on the coupling portion 151 by the spring 170 such that the rotation preventing portion 153 moves upward, and accordingly, the stopper protrusion 143 may be fixed by the rotation preventing portion 153.

If the stopper protrusion 143 is fixed by the rotation preventing portion 153, the stopper 140 may be prevented from rotating on the coupling hole 141 in the direction in which the catching protrusion 145 moves toward the catching portion 135.

If the stopper 140 is prevented from rotating, the door guide 110 can move downward while the catching protrusion 145 of the stopper 140 is not caught by the plurality of catching projections 137 when the door guide 110 moved to the top of the guide 120 again moves downward, and accordingly, the door guide 110 can move downward without being caught.

When the door guide 110 moves downward, the contact surface 159 may contact the moving unit 130 to enable the latch 150 to rotate on the coupling portion 151 such that the rotation preventing portion 153 moves downward.

If the latch 150 rotates on the coupling portion 151 such that the rotation preventing portion 153 moves downward, the stopper 140 may be rotated on the coupling hole 141 by the torsion spring 160 in the direction in which the catching protrusion 145 moves toward the catching portion 135, and accordingly, the stopper protrusion 143 fixed by the rotation preventing portion 153 may again climb over the inclined surface 155 of the rotation preventing portion 153 to thus be caught by the plurality of catching projections 137.

Hereinafter, operation in which the door guide 110 moves in the up-down direction to adjust the height will be described with reference to FIGS. 9 to 16.

Figure 9:
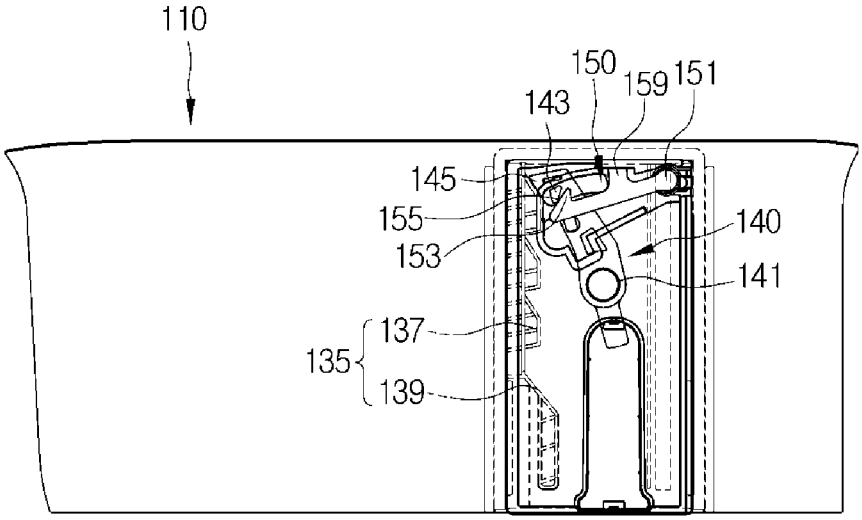
FIG. 9 is a side view of a door guide assembly according to an embodiment of the disclosure.
Figure 10:
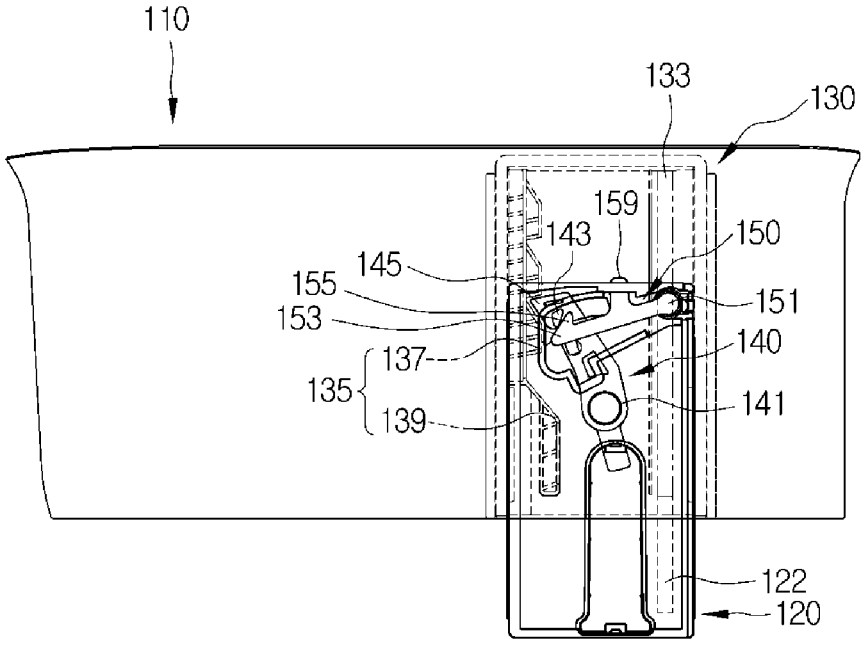
FIG. 10 shows a state when a door guide moves upward in the door guide assembly of FIG. 9.
Figure 11:
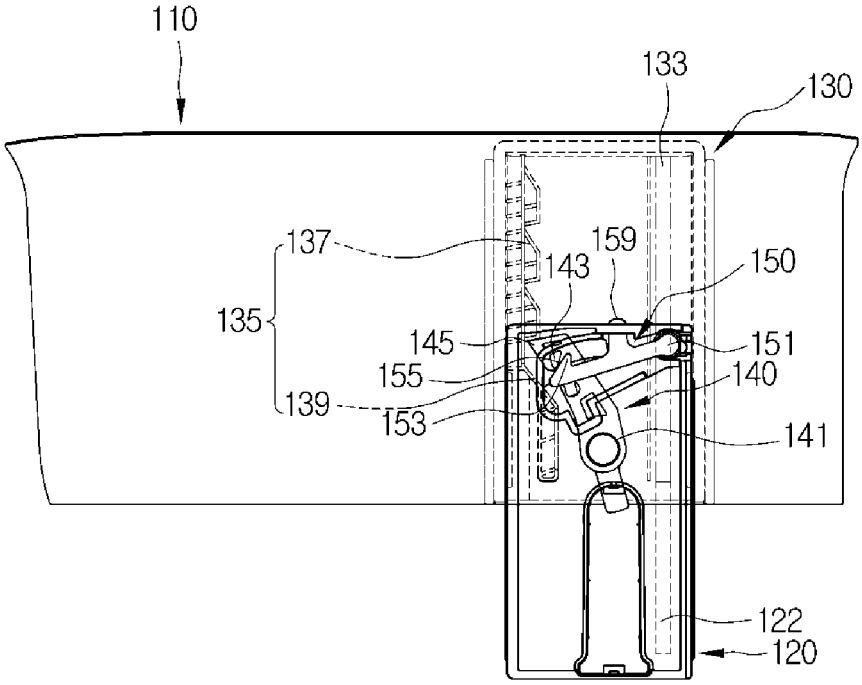
FIG. 11 shows a state when the door guide further moves upward so that a catching protrusion contacts a rotation guide portion in the door guide assembly of FIG. 10.
Figure 12:
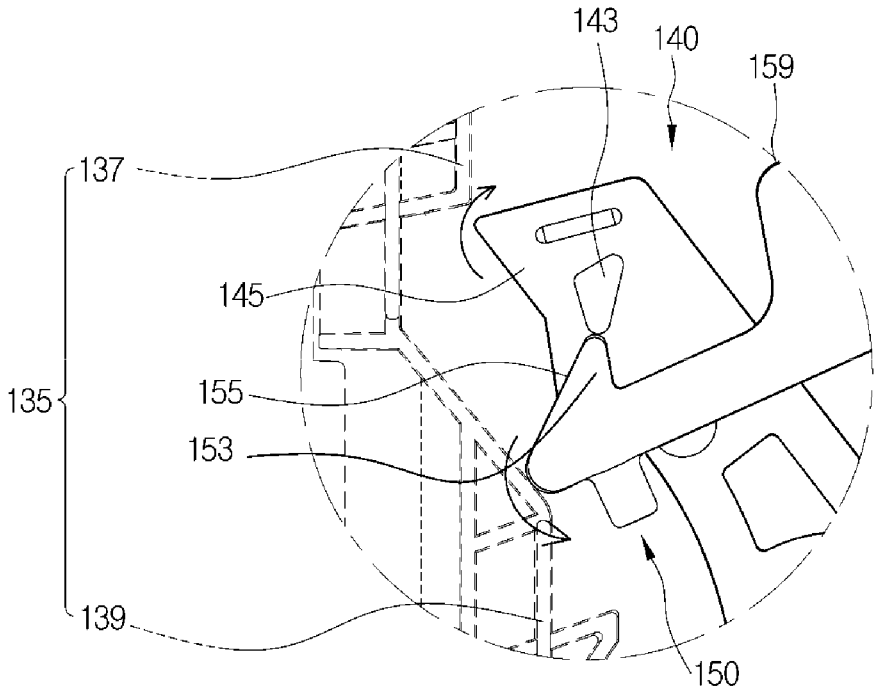
FIG. 12 shows a state when a catching protrusion according to an embodiment of the disclosure is guided by the rotation guide portion so that a stopper protrusion rotates to be fixed by a rotation preventing portion.
Figure 13:
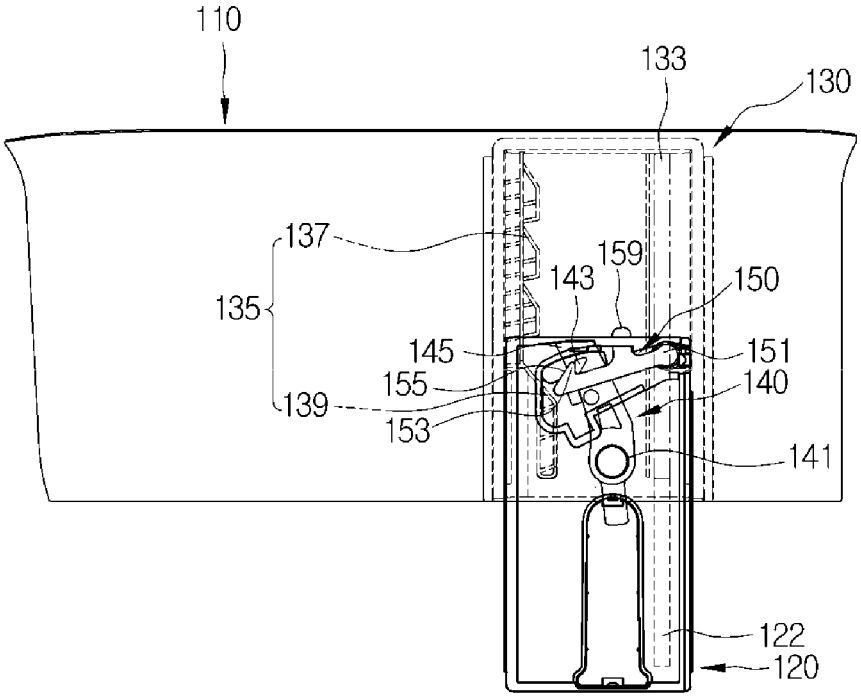
FIGS. 13 and 14 show states when the door guide moves downward in the state in which a stopper protrusion according to an embodiment of the disclosure is fixed by the rotation preventing portion.
Figure 14:
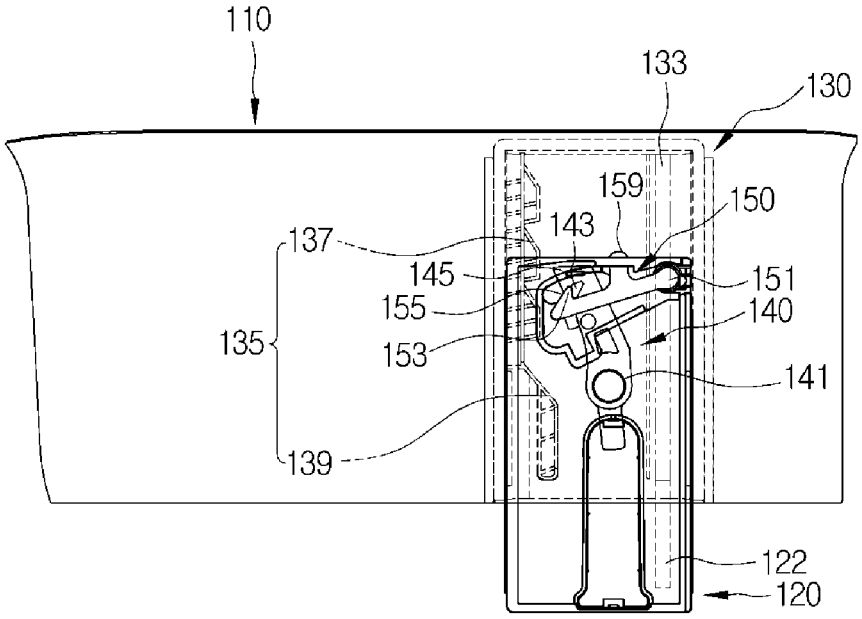
Figure 15:
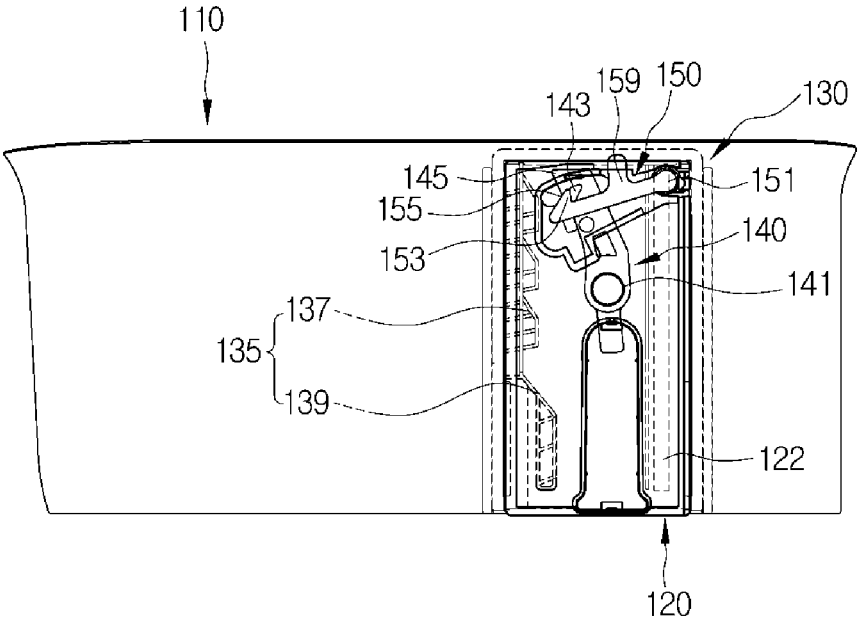
FIG. 15 shows a state when a door guide according to an embodiment of the disclosure moves downward so that a contact surface contacts a moving unit.
Figure 16:
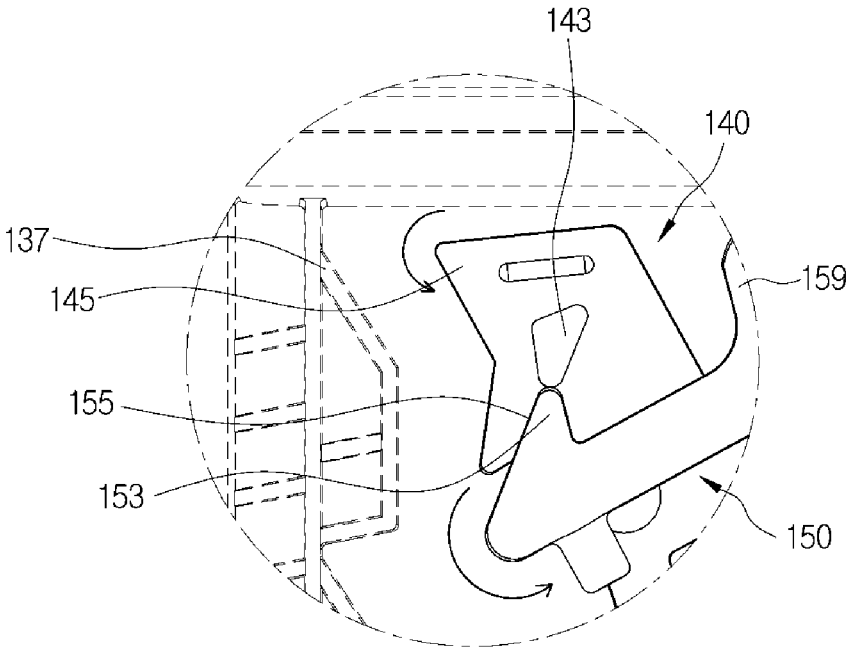
FIG. 16 shows a state when a contact surface according to an embodiment of the disclosure contacts the moving unit so that the stopper protrusion escapes from the rotation preventing portion.

FIG. 9 is a side view of a door guide assembly according to an embodiment of the disclosure, FIG. 10 shows a state when a door guide moves upward in the door guide assembly of FIG. 9, FIG. 11 shows a state when the door guide further moves upward so that a catching protrusion contacts a rotation guide portion in the door guide assembly of FIG. 10, FIG. 12 shows a state when a catching protrusion according to an embodiment of the disclosure is guided by the rotation guide portion so that a stopper protrusion rotates to be fixed by a rotation preventing portion, FIGS. 13 and 14 show states when the door guide moves downward in the state in which a stopper protrusion according to an embodiment of the disclosure is fixed by the rotation preventing portion, FIG. 15 shows a state when a door guide according to an embodiment of the disclosure moves downward so that a contact surface contacts a moving unit, and FIG. 16 shows a state when a contact surface according to an embodiment of the disclosure contacts the moving unit so that the stopper protrusion escapes from the rotation preventing portion.

As shown in FIG. 9, the door guide 110 may be fixed in the state in which the catching protrusion 145 of the stopper 140 is caught by the catching projection 137 which is the uppermost one of the plurality of catching projections 137, before the height of the door guide 110 is adjusted.

As shown in FIG. 10, if a user moves the door guide 110 upward in order to adjust the height of the door guide 110, the guide portion 133 of the moving unit 130 coupled with the door guide 110 may move upward along the guide rail 122 of the guide 120 so that the moving unit 130 moves upward together with the door guide 110.

If the user stops moving the door guide 110 after moving the door guide 110 to a desired height, the catching protrusion 145 of the stopper 140 may be caught by one of the plurality of catching projections 137 so that the door guide 110 is fixed.

In order for the user to again lower the door guide 110, the user may move the door guide 110 to the uppermost position, as shown in FIGS. 11 and 12.

When the door guide 110 moves to the uppermost position, the catching protrusion 145 of the stopper 140 may escape from the catching projection 137 to contact the rotation guide portion 139.

If the catching protrusion 145 contacts the rotation guide portion 139 to be guided by the rotation guide portion 139, the stopper 140 may rotate on the coupling hole 141 in the opposite direction of the direction in which the catching protrusion 145 moves toward the catching projections 137.

If the stopper 140 rotates on the coupling hole 141 in the opposite direction of the direction in which the catching protrusion 145 moves toward the catching projections 137, the stopper protrusion 143 may press the inclined surface 155 of the rotation preventing portion 153 downward.

At this time, the rotation preventing portion 153 of the latch 150 may rotate downward with respect to the coupling portion 151 by the stopper protrusion 143 so that the latch 150 may compress the spring 170.

Accordingly, the stopper protrusion 143 of the stopper 140 may climb over the inclined surface 155 of the rotation preventing portion 153 to move to the opposite side of the inclined surface 155.

If the stopper protrusion 143 climbs over the inclined surface 155 of the rotation preventing portion 153, the stopper protrusion 143 may be fixed by the rotation preventing portion 153 to prevent the stopper 140 from rotating, as shown in FIG. 13.

If the stopper 140 is prevented from rotating, the catching protrusion 145 may be released from the catching projections 137, as shown in FIG. 14, so that the user can move the door guide 110 downward since the door guide 110 is not caught.

If the door guide 110 moves to the lowermost position, as shown in FIG. 15, the contact portion 159 of the latch 150 may contact the moving unit 130.

If the contact portion 159 contacts the moving unit 130, the latch 150 may rotate on the coupling portion 151 such that the rotation preventing portion 153 moves downward, as shown in FIG. 16.

At this time, since the stopper 140 is rotated on the coupling hole 141 by the torsion spring 160 such that the catching protrusion 145 moves toward the catching projection 137, the stopper protrusion 143 may climb over the rotation preventing portion 153 to move to the inclined surface 155. If the stopper protrusion 143 climbs over the rotation preventing projection 137 to move to the inclined surface 155, the catching protrusion 145 may be caught by the catching projections 137 so that the door guide 110 is fixed, as shown in FIG. 9.

Hereinafter, a door guide assembly 200 according to another embodiment of the disclosure will be described with reference to FIGS. 17 to 29.

Figure 17:
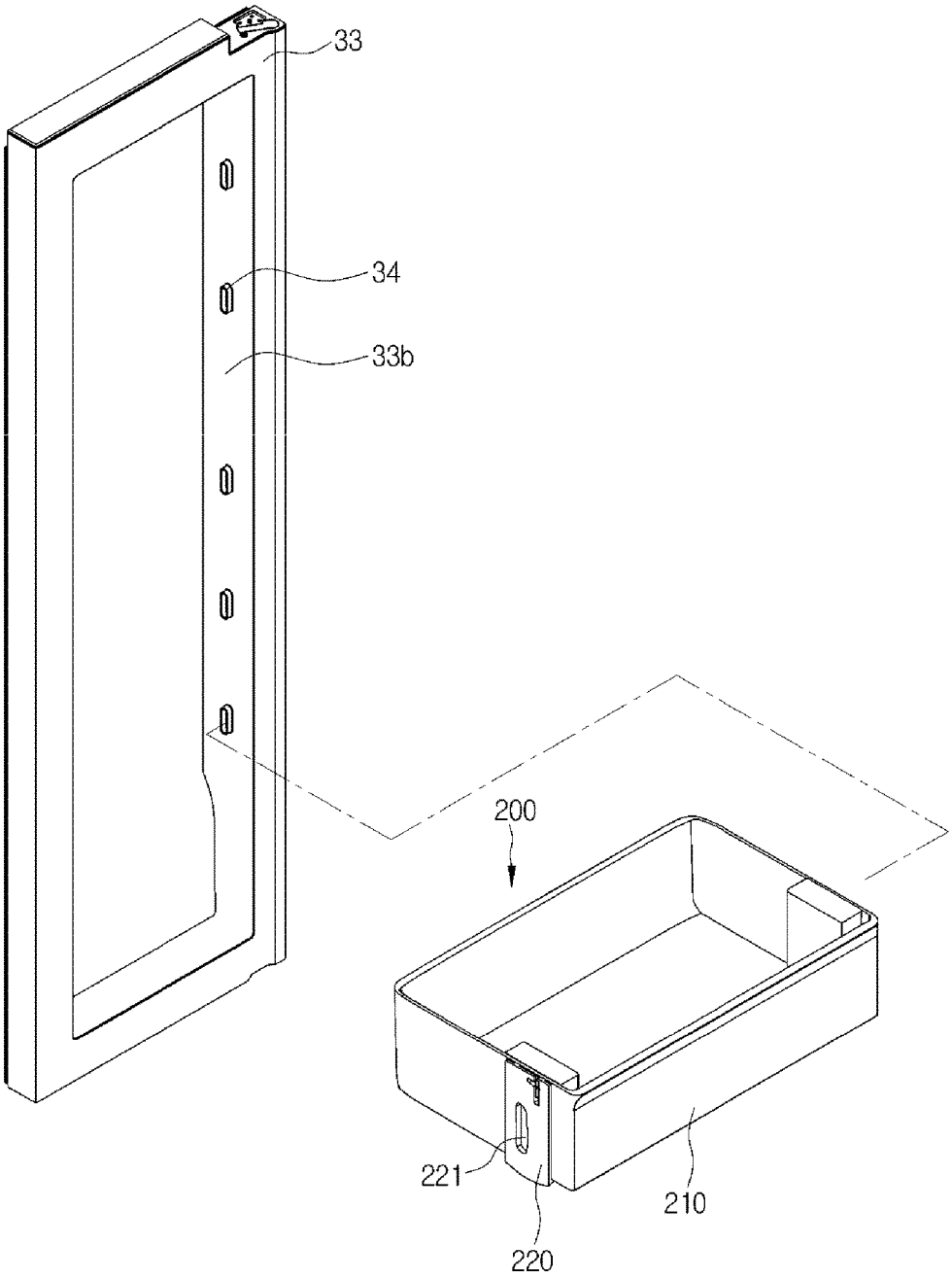
FIG. 17 shows a state when a door guide assembly according to another embodiment of the disclosure is coupled in an opening of a first door.
Figure 18:
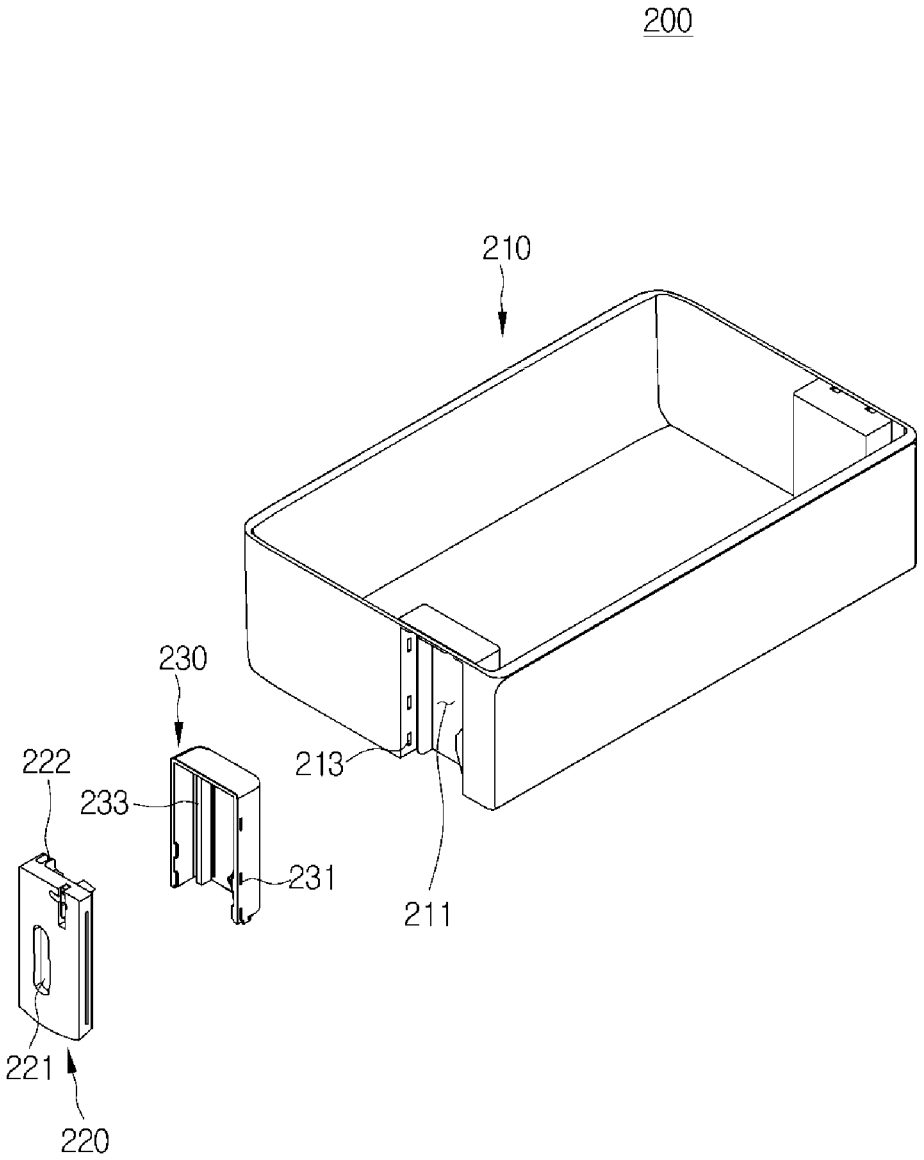
FIG. 18 is an exploded perspective view of the door guide assembly according to the other embodiment of the disclosure.
Figure 19:
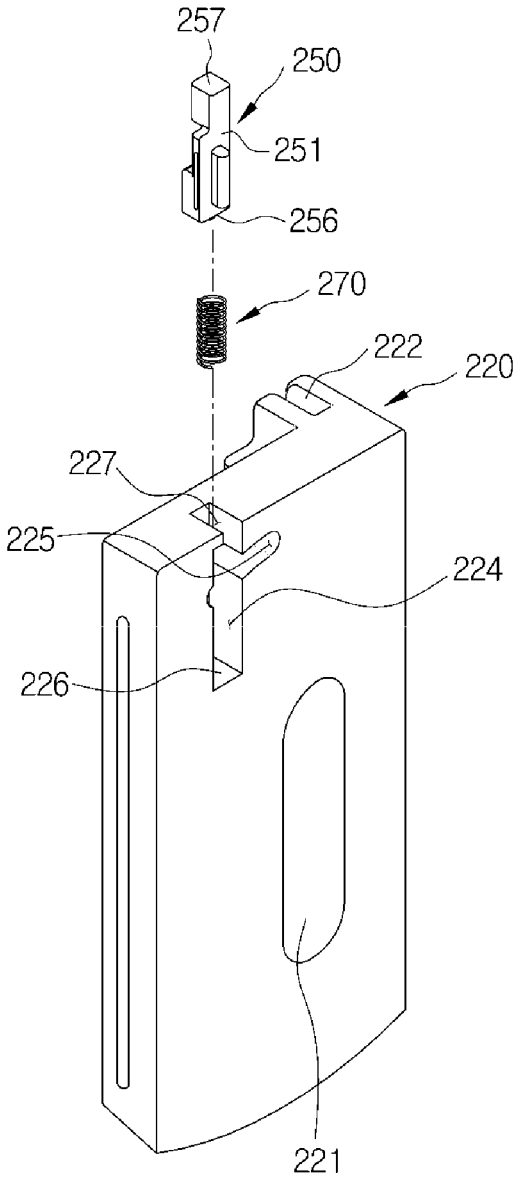
FIG. 19 shows a state when a latch is coupled with a guide according to another embodiment of the disclosure.
Figure 20:
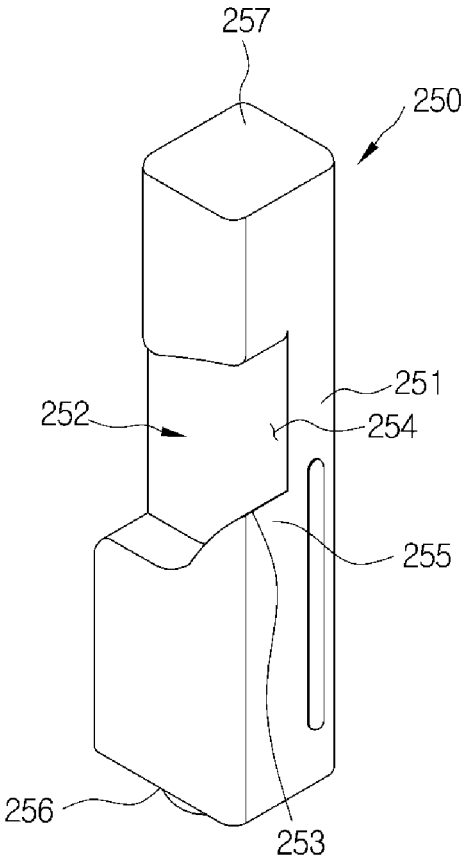
FIG. 20 shows a latch according to another embodiment of the disclosure.
Figure 21:
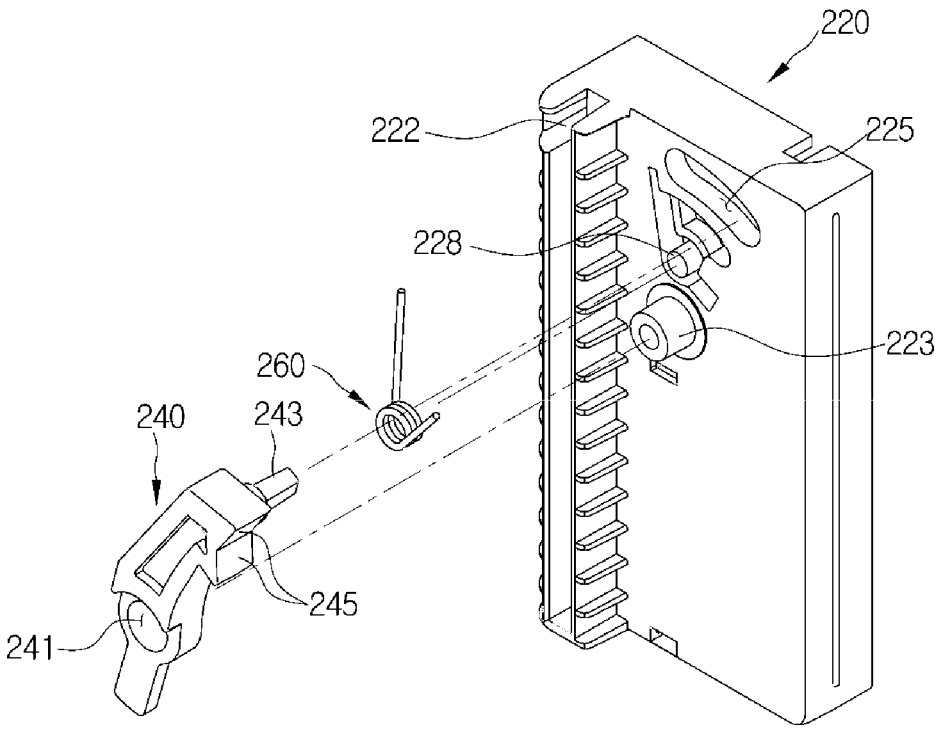
FIG. 21 shows a state when a stopper is coupled with a guide according to another embodiment of the disclosure.
Figure 22:
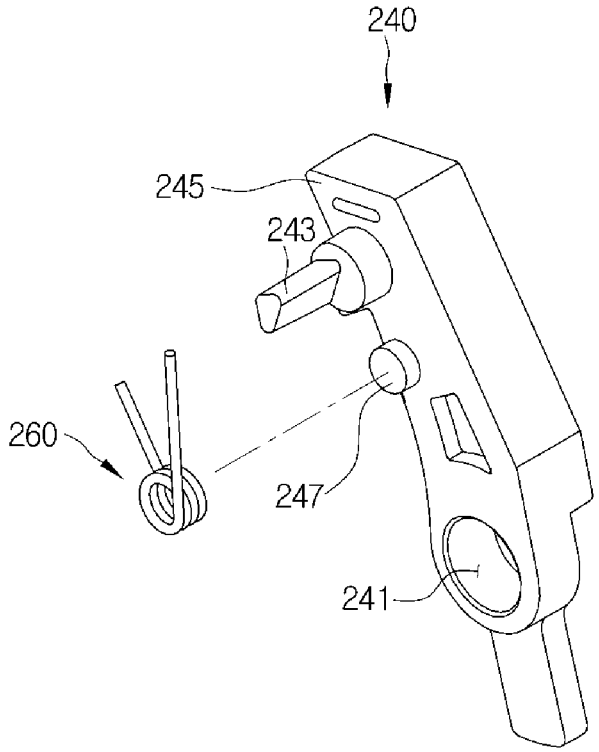
FIG. 22 shows a state when a torsion spring is coupled with a stopper according to another embodiment of the disclosure.
Figure 23:
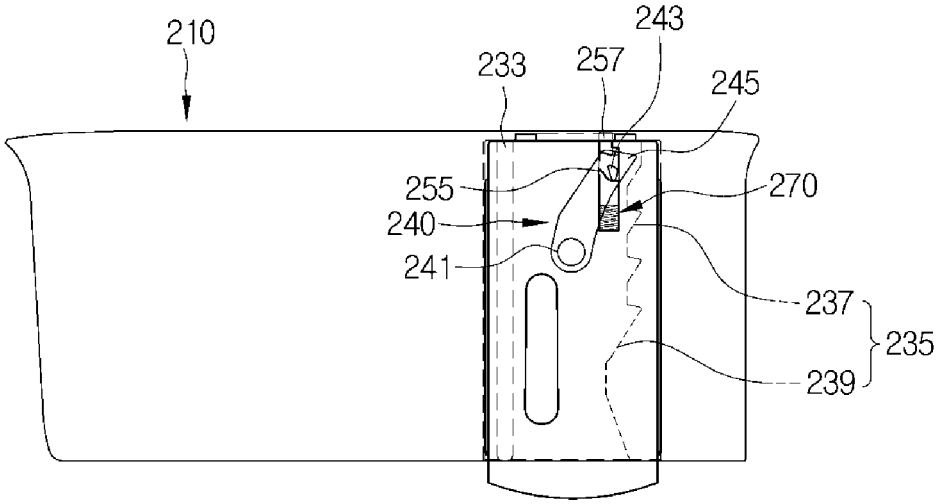
FIG. 23 is a side view of the door guide assembly according to the other embodiment of the disclosure.
Figure 24:
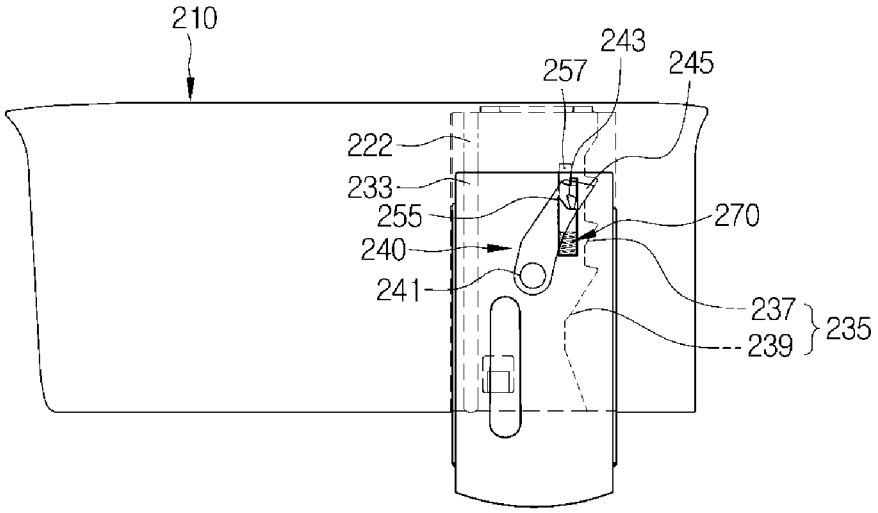
FIG. 24 shows a state when a door guide moves upward in the door guide assembly of FIG. 23.
Figure 25:
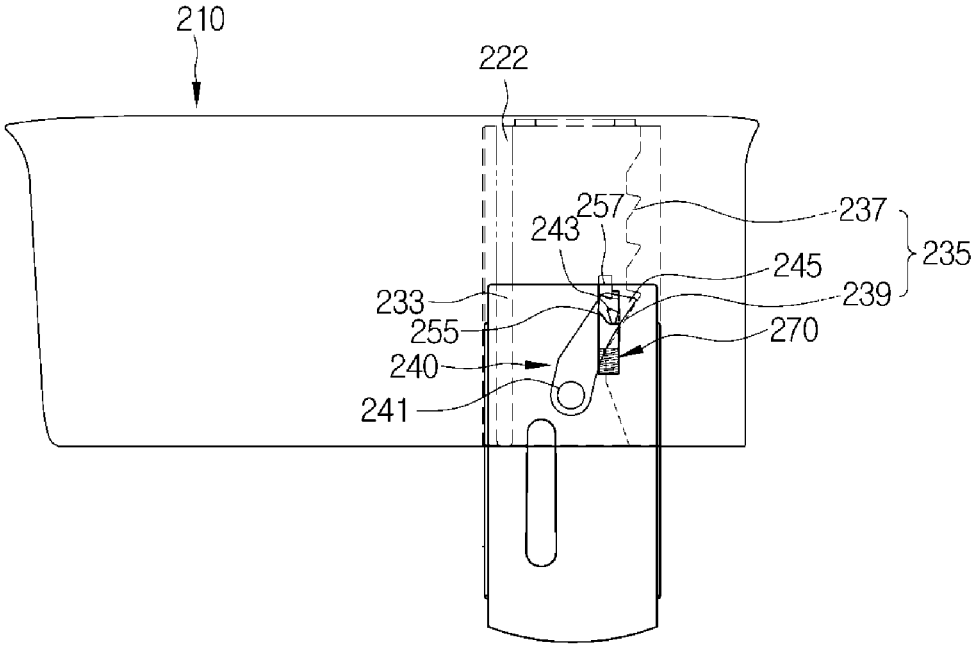
FIG. 25 shows a state when the door guide further moves upward so that a catching protrusion contacts a rotation guide portion in the door guide assembly of FIG. 24.
Figure 26:
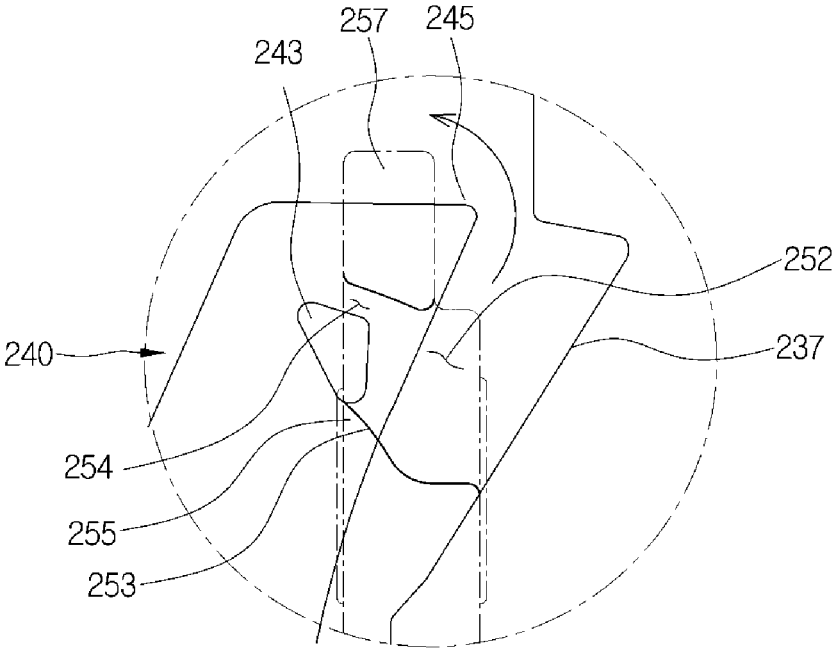
FIG. 26 shows a state when a catching protrusion according to another embodiment of the disclosure is guided by the rotation guide portion so that a stopper protrusion rotates to escape from a stopper protrusion accommodating portion through an opening to be fixed by a rotation preventing portion.
Figure 27:
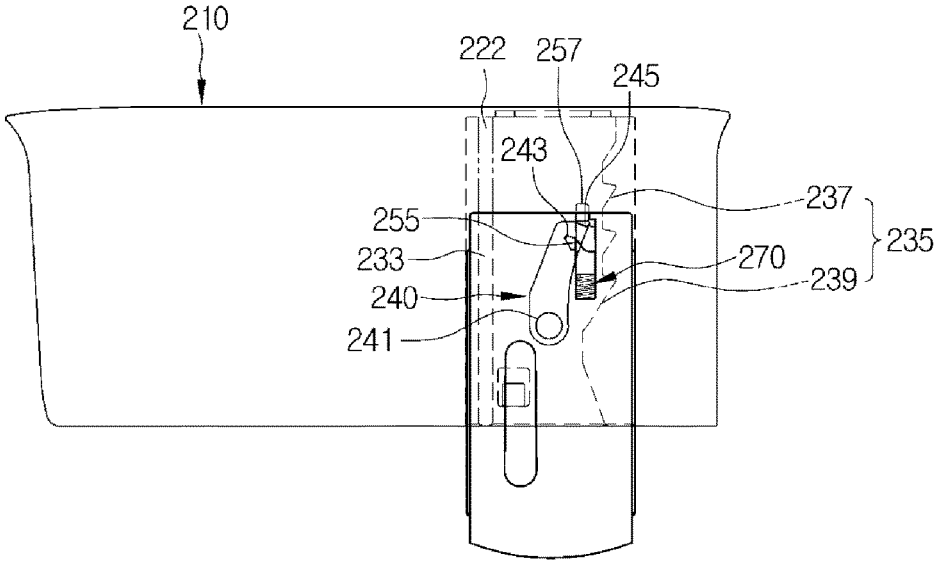
FIG. 27 shows a state when the door guide moves downward in the state in which a stopper protrusion according to another embodiment of the disclosure is fixed by the rotation preventing portion.
Figure 28:
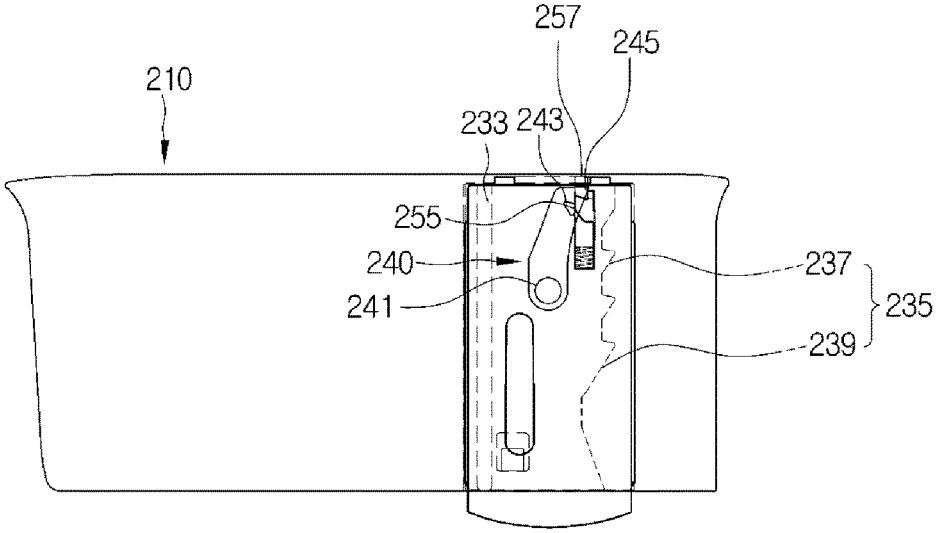
FIG. 28 shows a state when a door guide according to another embodiment of the disclosure moves downward so that a contact surface contacts a moving unit.
Figure 29:
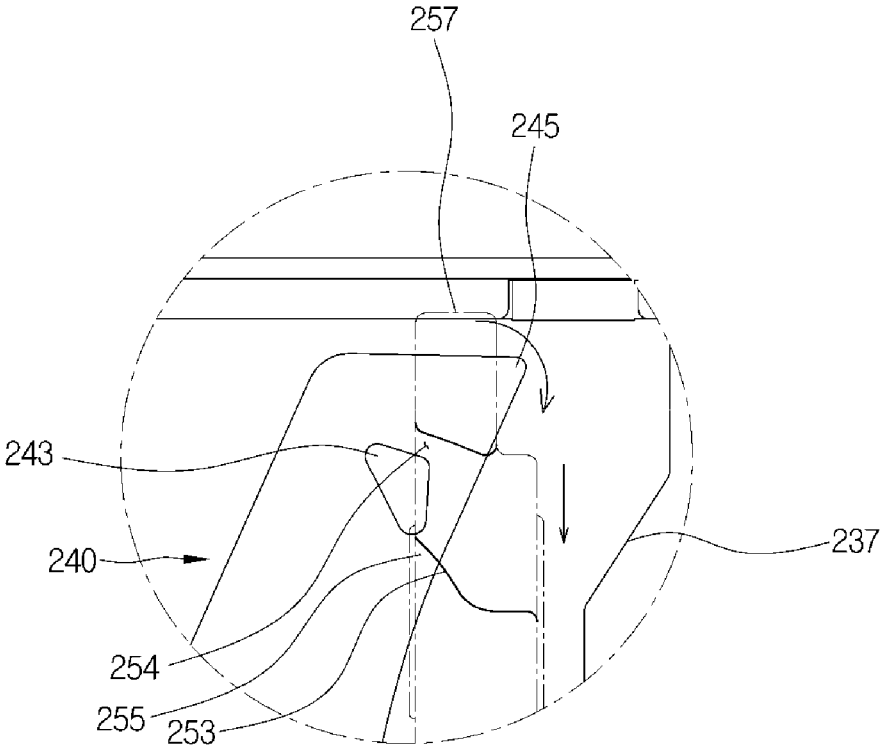
FIG. 29 shows a state when a contact surface according to another embodiment of the disclosure contacts the moving unit so that the latch moves downward, and the stopper protrusion escapes from the rotation preventing portion to be accommodated in a stopper protrusion accommodating portion through the opening.

FIG. 17 shows a state when a door guide assembly according to another embodiment of the disclosure is coupled in an opening of a first door, FIG. 18 is an exploded perspective view of the door guide assembly according to the other embodiment of the disclosure, FIG. 19 shows a state when a latch is coupled with a guide according to another embodiment of the disclosure, FIG. 20 shows a latch according to another embodiment of the disclosure, FIG. 21 shows a state when a stopper is coupled with a guide according to another embodiment of the disclosure, FIG. 22 shows a state when a torsion spring is coupled with a stopper according to another embodiment of the disclosure, FIG. 23 is a side view of the door guide assembly according to the other embodiment of the disclosure, FIG. 24 shows a state when a door guide moves upward in the door guide assembly of FIG. 23, FIG. 25 shows a state when the door guide further moves upward so that a catching protrusion contacts a rotation guide portion in the door guide assembly of FIG. 24, FIG. 26 shows a state when a catching protrusion according to another embodiment of the disclosure is guided by the rotation guide portion so that a stopper protrusion rotates to escape from a stopper protrusion accommodating portion through an opening to be fixed by a rotation preventing portion, FIG. 27 shows a state when the door guide moves downward in the state in which a stopper protrusion according to another embodiment of the disclosure is fixed by the rotation preventing portion, FIG. 28 shows a state when a door guide according to another embodiment of the disclosure moves downward so that a contact surface contacts a moving unit, and FIG. 29 shows a state when a contact surface according to another embodiment of the disclosure contacts the moving unit so that the latch moves downward, and the stopper protrusion escapes from the rotation preventing portion to be accommodated in a stopper protrusion accommodating portion through the opening.

As shown in FIGS. 17 to 22, the door guide assembly 200 may include a door guide 210 to store food therein, a guide 220 removably fixed on both side walls of the opening 33*b* of the first door 33, a moving unit 230 removably coupled with both side walls of the door guide 210 and guided by the guide 220 to move in the up-down direction, a stopper 240 coupled with the guide 220 and configured to adjust the position of the moving unit 230 in the up-down direction, and a latch 250 configured to fix the stopper 240 if the moving unit 130 moves up to the top of the guide 120.

A configuration in which the door guide 210 includes an accommodating groove 211 and a plurality of coupling grooves 213, a configuration in which the guide 220 includes a fixing portion 221, a guide rail 222, a stopper coupling portion 223, a through hole 225, an opening 227, and a torsion spring fixing portion 228, a configuration in which the moving unit 230 includes a plurality of coupling protrusions 231, a guide portion 233, and a catching portion 235 including a plurality of catching projections 237 and a rotation guide portion 239, and a configuration in which the stopper 240 includes a coupling hole 241, a stopper protrusion 243, a catching protrusion, and a torsion spring coupling portion 247 are the same as the corresponding configurations of the door guide assembly 100 shown in FIGS. 4 to 15, and accordingly, detailed descriptions thereof will be omitted. Hereinafter, configurations that are different from those of the door guide assembly 100 shown in FIGS. 4 to 15 will be described.

The guide 220 may include a latch accommodating groove 224 to accommodate the latch 250 such that the latch 250 is movable in the up-down direction, and a second support 226 configured to support one end of a spring 270 below the latch accommodating groove 224.

The latch 250 may include a body 251 accommodated in the latch accommodating groove 224 of the guide 220 in such a way to be movable in the up-down direction, a stopper protrusion accommodating portion 252 in which the stopper protrusion 243 of the stopper 240 penetrating the through hole 225 is accommodated, a rotation preventing portion 255 configured to catch the stopper protrusion 243 of the stopper 240 to prevent the stopper 240 from rotating, a first support 256 configured to support the spring 270, and a contact surface 257 formed on the top of the body 251 and contacting the moving unit 230 when the door guide 210 moves upward and then again moves downward.

In one surface of the stopper protrusion accommodating portion 252 in which the stopper protrusion 243 is accommodated, an inclined surface 253 may be formed, and around the inclined surface 253 of the stopper protrusion accommodating portion 252, an opening 254 may be formed so that the stopper protrusion 243 can escape from the stopper protrusion accommodating portion 252.

Hereinafter, operation in which the door guide 210 moves in the up-down direction to adjust the height will be described with reference to FIGS. 23 to 29.

As shown in FIG. 23, the door guide 210 may be fixed in the state in which the catching protrusion 245 of the stopper 240 is caught by the catching projection 237 which is the uppermost one of the plurality of catching projections 237, before the height of the door guide 210 is adjusted.

As shown in FIG. 24, if a user moves the door guide 210 upward in order to adjust the height of the door guide 210, the guide portion 233 of the moving unit 230 coupled with the door guide 210 may move upward along the guide rail 222 of the guide 220 so that the moving unit 230 moves upward together with the door guide 210.

If the user stops moving the door guide 210 after moving the door guide 210 to a desired height, the catching protrusion 245 of the stopper 240 may be caught by one of the plurality of catching projections 237 so that the door guide 210 is fixed.

In order for the user to again lower the door guide 210, the user may move the door guide 210 to the uppermost position, as shown in FIGS. 25 and 26.

When the door guide 210 moves to the uppermost position, the catching protrusion 245 of the stopper 240 may escape from the catching projection 237 to contact the rotation guide portion 239.

If the catching protrusion 245 contacts the rotation guide portion 239 to be guided by the rotation guide portion 239, the stopper 240 may rotate on the coupling hole 241 in the opposite direction of the direction in which the catching protrusion 245 moves toward the catching projection 237.

If the stopper 240 rotates on the coupling hole 241 in the opposite direction of the direction in which the catching protrusion 245 moves toward the catching projection 237, the stopper protrusion 243 may press the lower surface of the stopper protrusion accommodating portion 252.

At this time, the latch 250 may move downward by the stopper protrusion 243 to compress the spring 270.

Accordingly, the stopper protrusion 243 of the stopper 240 may escape from the stopper protrusion accommodating portion 252 through the opening 254 to be fixed by the rotation preventing portion 255, as shown in FIG. 26, and to prevent the stopper 240 from rotating.

If the stopper 240 is prevented from rotating, the catching protrusion 245 may be released from the catching projection 237, as shown in FIG. 27, so that the user can move the door guide 210 downward since the door guide 210 is not caught.

If the door guide 210 moves to the lowermost position, as shown in FIG. 28, the contact surface 259 of the latch 250 may contact the moving unit 230.

If the contact surface 259 contacts the moving unit 230, the latch 250 may move downward while compressing the spring 270, as shown in FIG. 29.

At this time, since the stopper 140 is rotated on the coupling hole 241 by a torsion spring 260 in the direction in which the catching protrusion 245 moves toward the catching projection 237, the stopper protrusion 243 may be accommodated in the inside of the stopper protrusion accommodating portion 252 through the opening 254. If the stopper protrusion 243 is accommodated in the inside of the stopper protrusion accommodating portion 252 through the opening 254, the catching protrusion 245 may be caught by the catching projection 237 so that the door guide 210 is fixed, as shown in FIG. 23.

Hereinafter, a door guide assembly 300 according to another embodiment of the disclosure will be described with reference to FIGS. 30 to 39.

Figure 30:
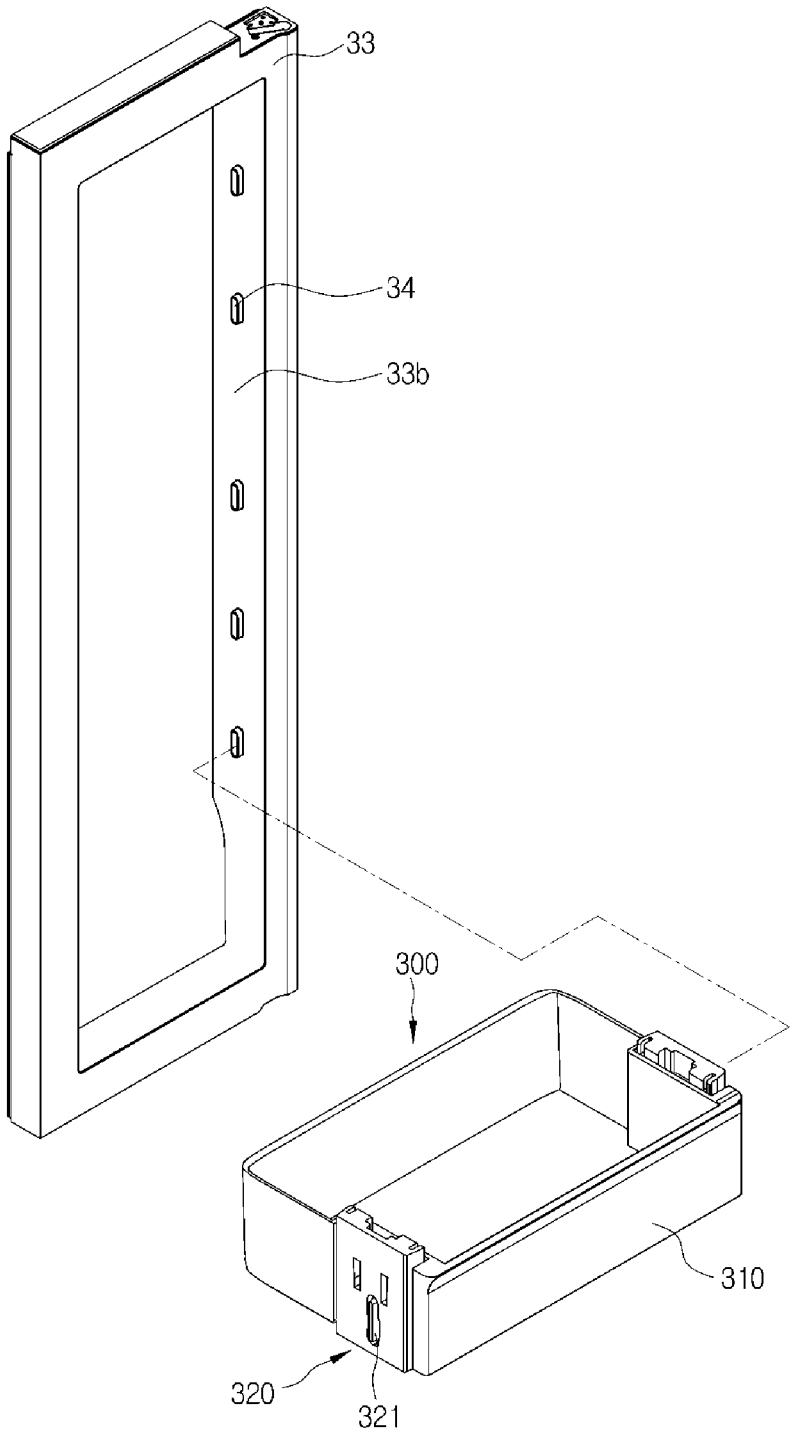
FIG. 30 shows a state when a door guide assembly according to another embodiment of the disclosure is coupled in an opening of a first door.
Figure 31:
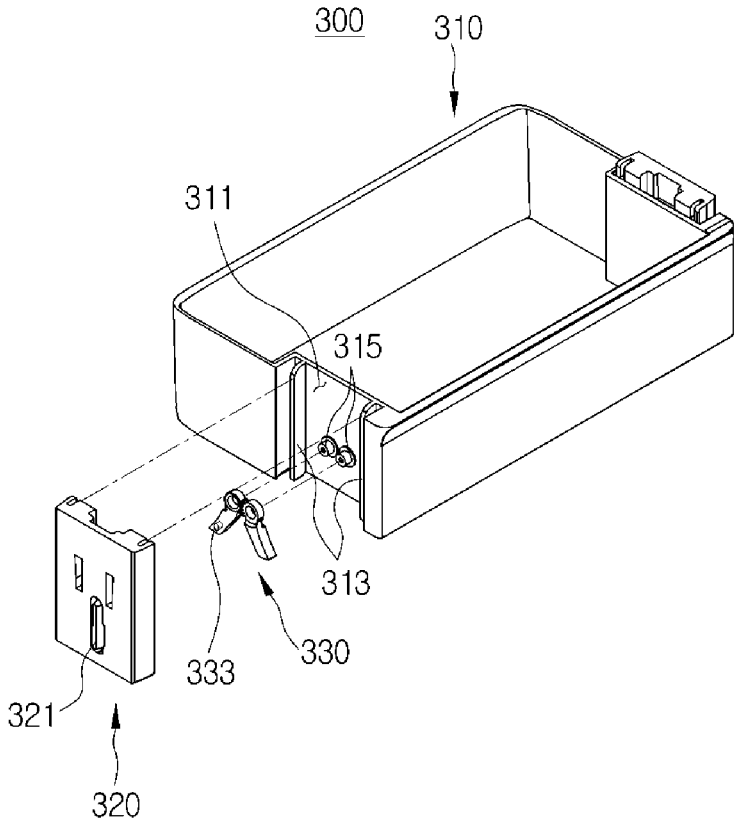
FIG. 31 is an exploded perspective view of the door guide assembly according to the other embodiment of the disclosure.
Figure 32:
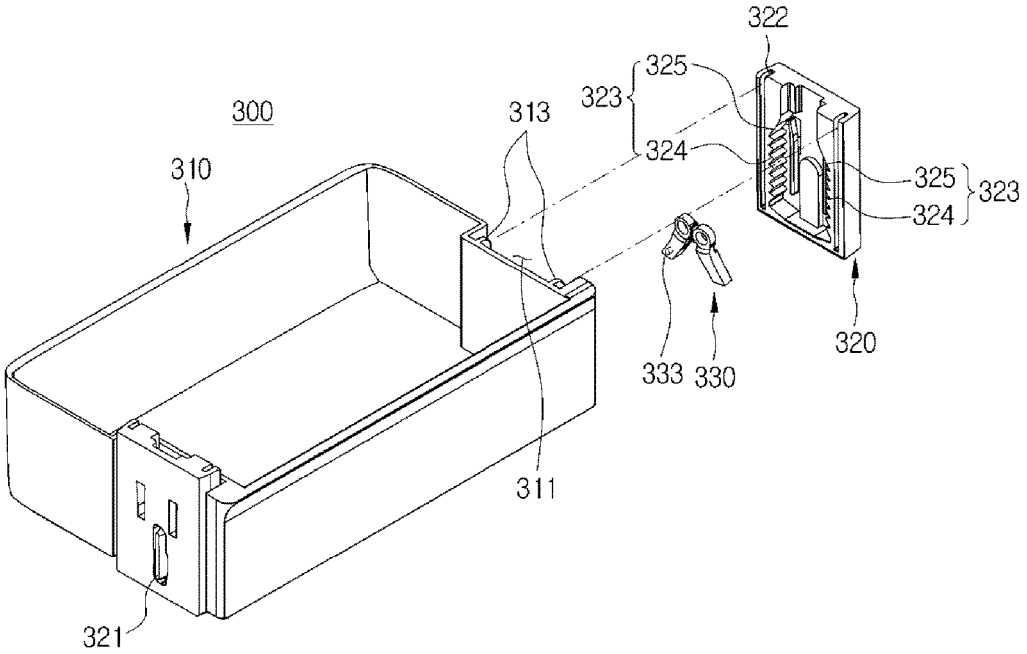
FIG. 32 is an exploded perspective view of the door guide assembly shown in FIG. 31 when it is seen from a different view angle.
Figure 33:
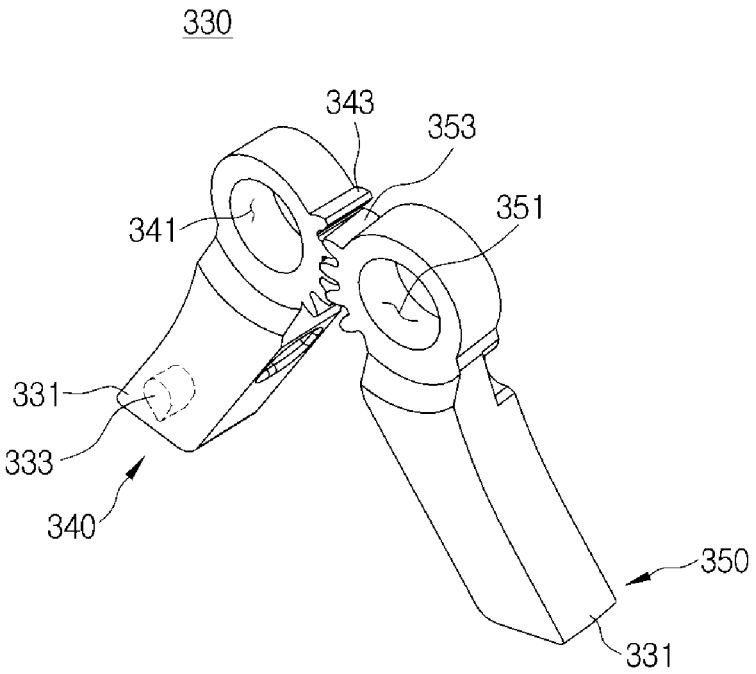
FIG. 33 shows a stopper according to another embodiment of the disclosure.
Figure 34:
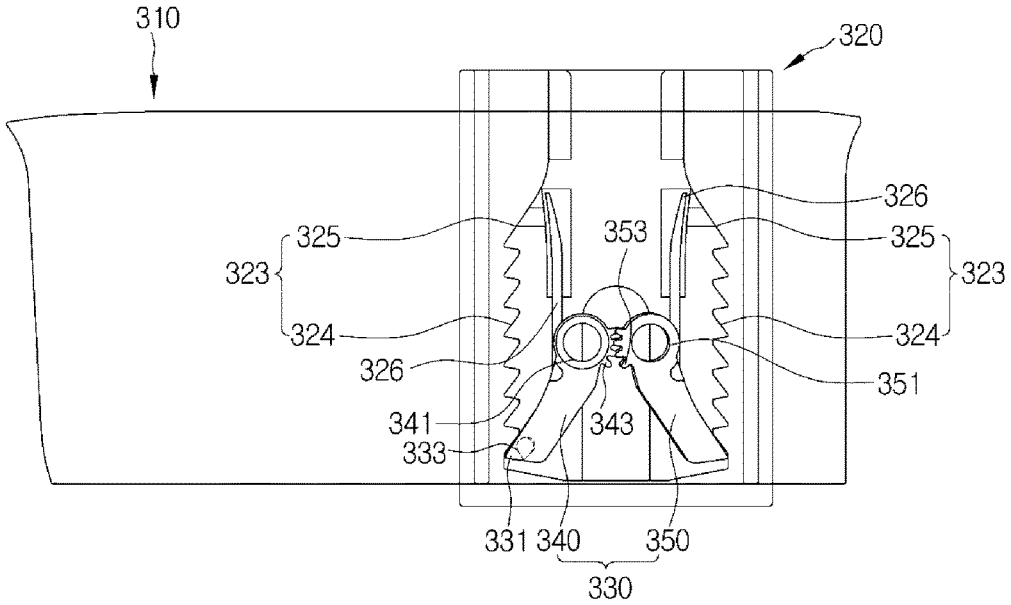
FIG. 34 is a side view of the door guide assembly according to the other embodiment of the disclosure.
Figure 35:
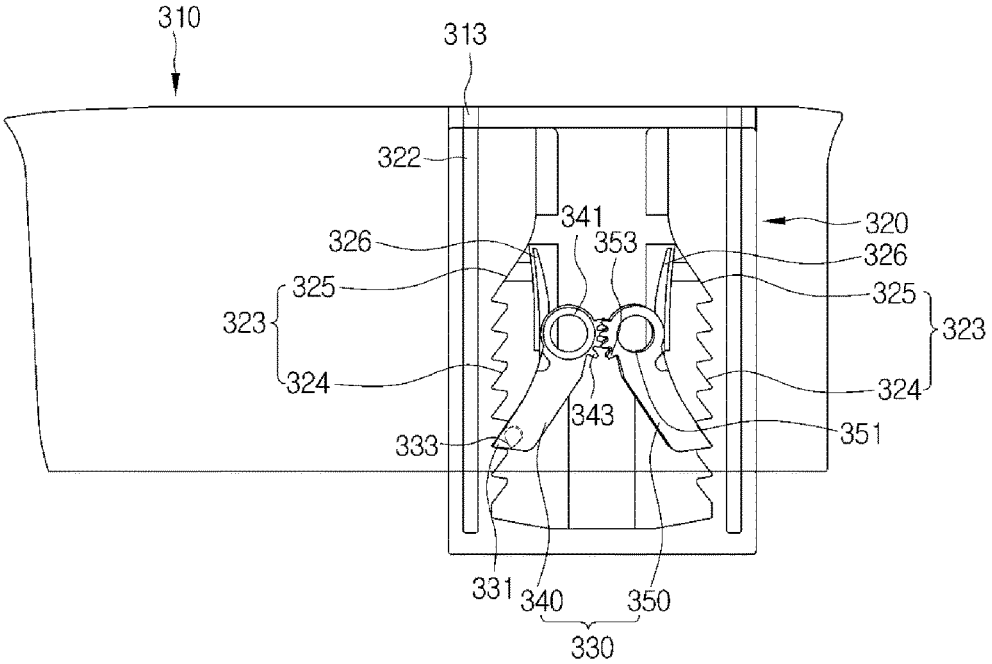
FIG. 35 shows a state when a door guide moves upward in the door guide assembly of FIG. 34.
Figure 36:
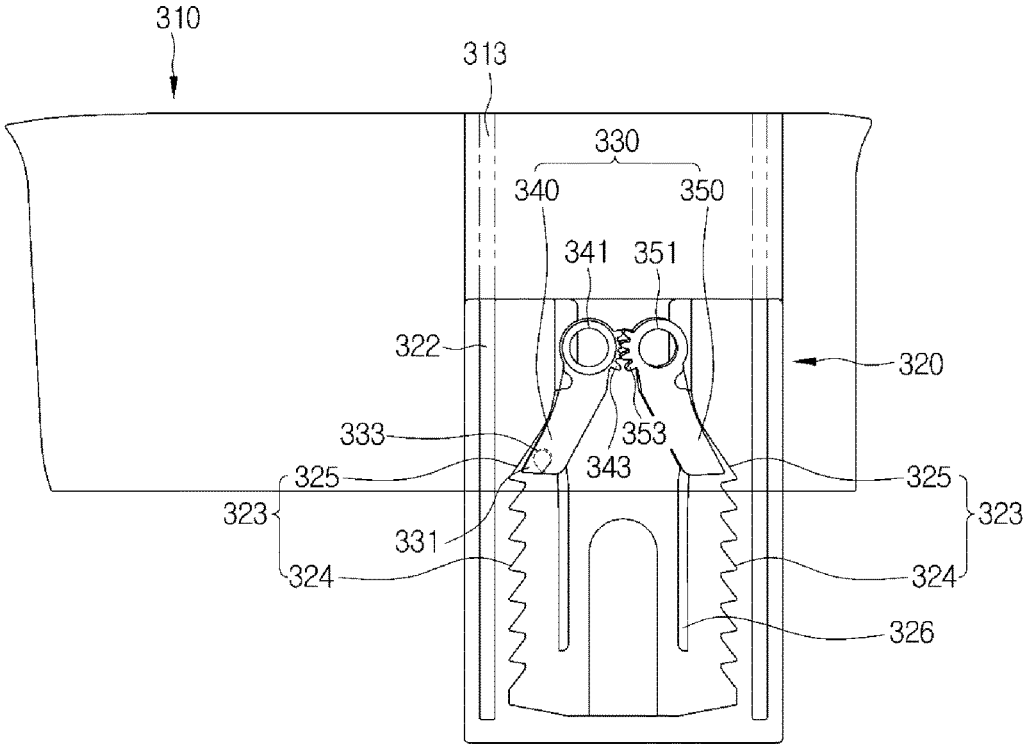
FIG. 36 shows a state when a catching protrusion according to another embodiment of the disclosure contacts a rotation guide portion to be guided.
Figure 37:
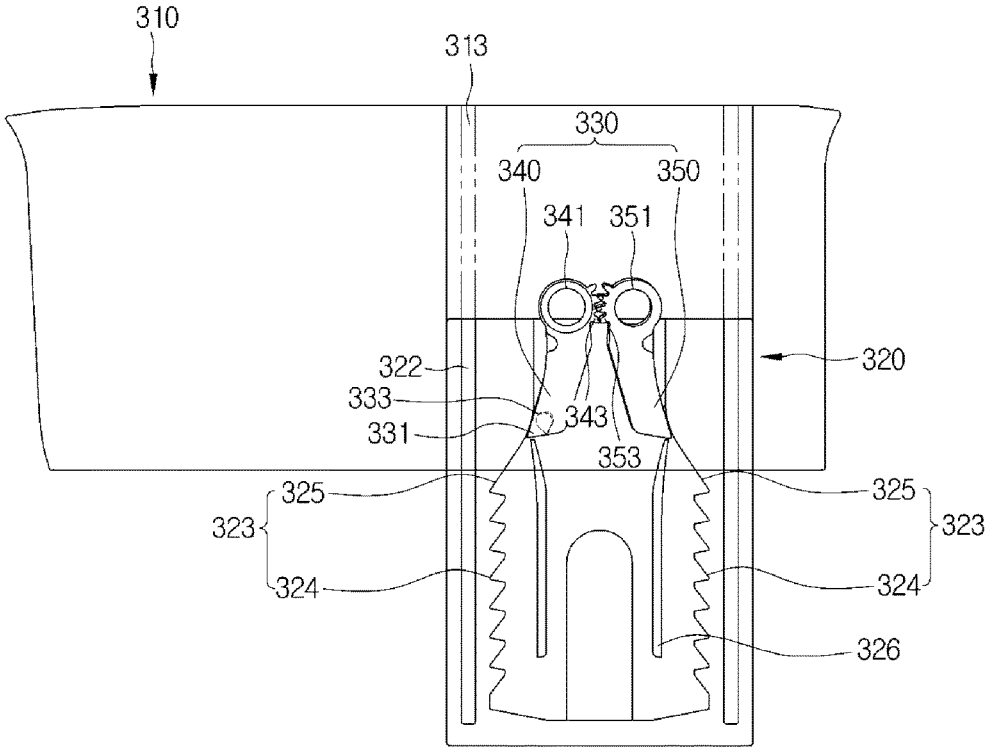
FIG. 37 shows a state when the catching protrusion contacts the rotation guide portion so that a stopper rotates in the door guide assembly of FIG. 36.
Figure 38:
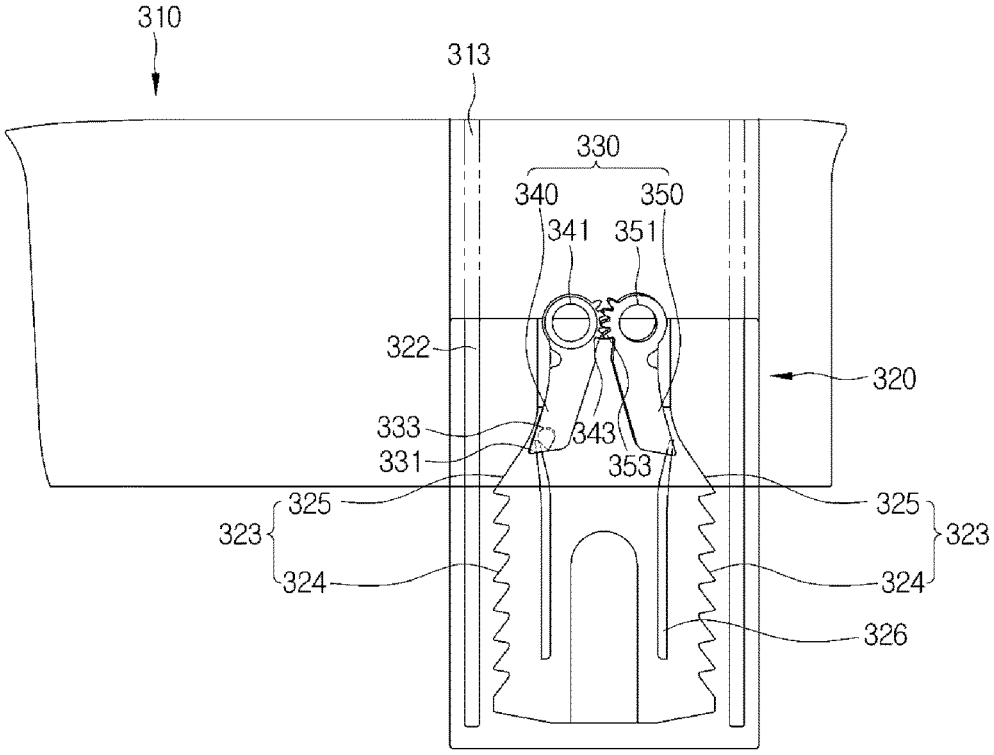
FIG. 38 shows a state when the door guide moves downward while the stopper protrusion is fixed by a fixing rib to be prevented from rotating in the state in which the stopper has rotated, in the door guide assembly of FIG. 37.
Figure 39:
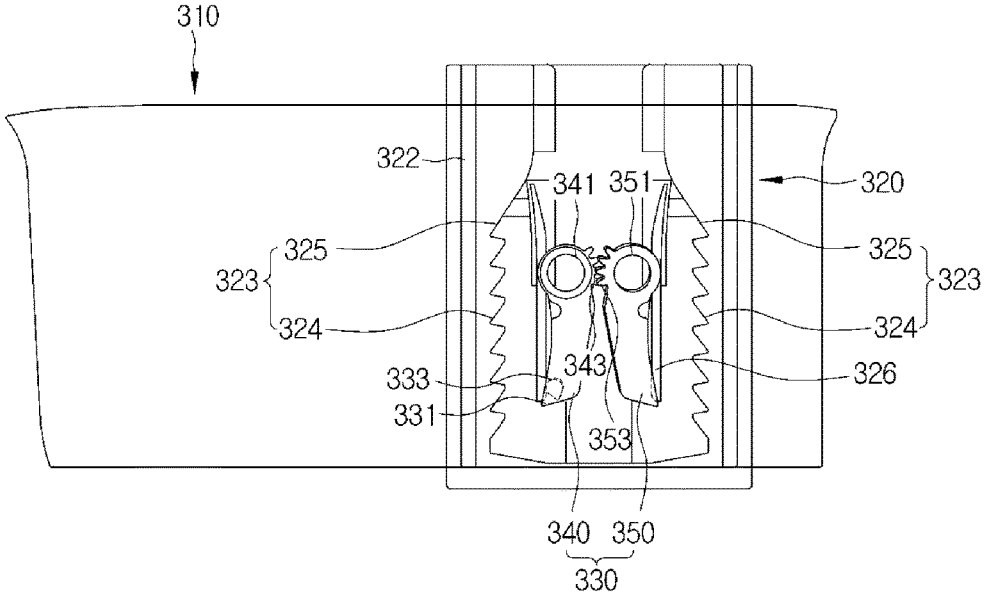
FIG. 39 shows a state when the door guide further moves downward in the door guide assembly of FIG. 38.

FIG. 30 shows a state when a door guide assembly according to another embodiment of the disclosure is coupled in an opening of a first door, FIG. 31 is an exploded perspective view of the door guide assembly according to the other embodiment of the disclosure, FIG. 32 is an exploded perspective view of the door guide assembly shown in FIG. 31 when it is seen from a different view angle, FIG. 33 shows a stopper according to another embodiment of the disclosure, FIG. 34 is a side view of the door guide assembly according to the other embodiment of the disclosure, FIG. 35 shows a state when a door guide moves upward in the door guide assembly of FIG. 34, FIG. 36 shows a state when a catching protrusion according to another embodiment of the disclosure contacts a rotation guide portion to be guided, FIG. 37 shows a state when the catching protrusion contacts the rotation guide portion so that a stopper rotates in the door guide assembly of FIG. 36, FIG. 38 shows a state when the door guide moves downward while the stopper protrusion is fixed by a fixing rib to be prevented from rotating in the state in which the stopper has rotated, in the door guide assembly of FIG. 37, and FIG. 39 shows a state when the door guide further moves downward in the door guide assembly of FIG. 38.

As shown in FIGS. 30 to 33, the door guide assembly 300 may include a door guide 310 to store food therein, a guide 320 removably fixed on both side walls of the opening 33*b* of the first door 33 and configured to guide the door guide 310 to move in the up-down direction, a stopper 330 coupled with the door guide 310 and configured to adjust the position of the door guide 310, and a fixing rib 326 formed in the guide 320, and configured to fix the stopper 330 to prevent the stopper 330 from rotating if the door guide 310 moves up to the top of the guide 320.

An accommodating groove 311 to accommodate the guide 320 may be formed in both side walls of the door guide 310, and in the inside of the accommodating groove 311, a guide portion 313 guided in the up-down direction along the guide rail 322 of the guide 320 which will be described later, and a pair of stopper coupling portions 315 with which the stopper 330 is rotatably coupled may be disposed.

The guide 320 may include a fixing portion 321 removably fixed at the protrusion 34 formed on both side walls of the opening 33*b*, the guide rail 322 configured to guide the guide portion 313 such that the door guide 310 moves in the up-down direction, a catching portion 323 having a plurality of catching projections 324 arranged in the up-down direction, and a fixing rib 326 configured to fix the stopper 330 to prevent the stopper 330 from rotating.

A pair of stoppers 330 including a first stopper 340 and a second stopper 350 may be provided, and in the first stopper 340 and the second stopper 350, a first coupling hole 341 and a second coupling hole 351 may be respectively formed to be rotatably coupled with the stopper coupling portions 315.

In each of the first and second stoppers 340 and 350, a catching protrusion 331 may be formed to be caught by or released from the plurality of catching projections 324 formed in the guide 320, and the catching protrusion 331 may be formed at the other end of the stopper 330 that is opposite to the end of the stopper 330 in which the first and second coupling holes 341 and 351 are formed.

On the outer surfaces of the first coupling hole 341 and the second coupling hole 351, a first gear portion 343 and a second gear portion 353 may be respectively formed in such a way to be interlocked with each other. When the first stopper 340 rotates on the first coupling hole 341, the second stopper 350 may rotate on the second coupling hole 351 in the opposite direction of the direction in which the first stopper 340 rotates.

In at least one of the first stopper 340 and the second stopper 350, a stopper protrusion 333 may be formed, and the stopper protrusion 333 may be formed adjacent to the catching protrusion 331 and protrude toward the guide 320.

A pair of catching portions 323 may be formed in the guide 320, and above the plurality of catching projections 324, a pair of rotation guide portions 325 may be formed to guide the first stopper 340 and the second stopper 350 to rotate on the first coupling hole 341 and the second coupling hole 351, respectively, in the opposite direction of the direction in which the catching protrusions 331 move toward the catching projections 324.

A pair of fixing ribs 326 may be disposed between the first coupling hole 341 and the catching portion 323 adjacent to the first coupling hole 341, and between the second coupling hole 351 and the catching portion 323 adjacent to the second coupling hole 351. The fixing ribs 326 may be guided by the rotation guide portions 325 to fix the stopper protrusions 333 of the stopper 330 escaped from the catching projections 324, thereby preventing the stopper 330 from rotating.

Hereinafter, operation in which the door guide 310 moves in the up-down direction to adjust the height will be described with reference to FIGS. 34 to 39.

As shown in FIG. 34, the door guide 310 may be fixed in the state in which the catching protrusions 331 of the first stopper 340 and the second stopper 350 are caught by the catching projections 324 which are the lowermost ones of the plurality of catching projections 324, before the height of the door guide 310 is adjusted.

As shown in FIG. 35, if a user moves the door guide 310 upward in order to adjust the height of the door guide 310, the guide portion 313 disposed in the door guide 310 may move upward along the guide rail 322 of the guide 320.

If the user stops moving the door guide 310 after moving the door guide 310 to a desired height, the catching protrusions 331 of the first stopper 340 and the second stopper 350 may be caught by ones of the plurality of catching projections 324 so that the door guide 310 is fixed.

In order for the user to again lower the door guide 310, the user may move the door guide 310 to the uppermost position, as shown in FIGS. 36 and 37.

When the door guide 210 moves to the uppermost position, the catching protrusions 331 of the first stopper 340 and the second stopper 350 may escape from the catching projections 324 to contact the rotation guide portions 325.

If the catching protrusions 331 contact the rotation guide portions 325 to be guided by the rotation guide portions 325, the first stopper 340 and the second stopper 350 may rotate on the first coupling hole 341 and the second coupling hole 351, in the opposite direction of the direction in which the catching protrusions 331 move toward the catching projections 324.

If the first stopper 340 and the second stopper 350 rotate on the first coupling hole 341 and the second coupling hole 351 in the opposite direction of the direction in which the catching protrusions 331 move toward the catching projections 324, the first stopper 340 and the second stopper 350 may be prevented from respectively rotating on the first coupling hole 341 and the second coupling hole 351 toward the catching projections 324, as shown in FIG. 37.

If the door guide 310 moves downward in the state in which the first stopper 340 and the second stopper 350 are fixed to be prevented from rotating, the stopper protrusions 333 may be fixed by the fixing ribs 326, so that the first stopper 340 and the second stopper 350 may be maintained in the state in which they are prevented from rotating, as shown in FIG. 38.

If the first stopper 340 and the second stopper 350 are prevented from rotating, the catching protrusions 331 may be released from the catching projections 324, as shown in FIG. 39, so that the user can move the door guide 310 downward since the door guide 310 is not caught.

If the door guide 310 moves to the lowermost position, the stopper protrusions 333 may be released from the fixing ribs 326, and the first stopper 340 and the second stopper 350 may rotate on the first coupling hole 341 and the second coupling hole 351, respectively, toward the catching projections 324 so that the catching protrusions 331 may be caught by the catching projections 324.

If the catching protrusions 331 are caught by the catching projections 324, the door guide 310 may be fixed.

According to the example embodiments of the disclosure, the height of the door guide can be adjusted according to food stored in the door guide.

Although the door guide assembly and the refrigerator having the same have been described above based on specific shapes and directions with reference to the accompanying drawings, it would be appreciated by those skilled in the art that changes may be made without departing from the principles and spirit of the disclosure. That is, although example embodiments have been shown and described, it would be appreciated by those skilled in the art that changes may be made to these embodiments without departing from the principles and spirit of the disclosure, the scope of which is defined in the claims and their equivalents.

What is claimed is:

1. A refrigerator, comprising:

a main body having a storage chamber;

a first door rotatably connected to a front surface of the main body, configured to open or close the storage chamber, and having an opening in which at least one door guide assembly is arranged; and a second door rotatably connected to a front surface of the first door, and configured to open or close the opening, wherein the door guide assembly includes:

a guide removably fixed on side walls of the opening, and including a catching portion having catching projections arranged in an up-down direction, a door guide including an accommodating groove to accommodate the guide at side walls of the accommodating groove, and guided by the guide to move in the up-down direction, a stopper disposed in an inside of the accommodating groove, and caught by or released from the catching projections to adjust a position of the door guide, and a fixing rib disposed in the guide, and configured to fix the stopper released from the catching projections, if the door guide moves up to a top of the guide.

2. The refrigerator according to claim 1, wherein the guide includes a guide rail configured to guide the door guide to move in the up-down direction, and a fixing portion removably fixed at a protrusion disposed on the side walls of the opening.

3. The refrigerator according to claim 2, wherein a guide portion guided along the guide rail, and stopper coupling portions with which the stopper is rotatably coupled are disposed in an inside of the accommodating groove.

4. The refrigerator according to claim 3, wherein the stopper includes a first stopper and a second stopper, and the stopper coupling portions include a first stopper coupling portion and a second stopper coupling portion, the first stopper includes a first coupling hole rotatably coupled with the first stopper coupling portion and a first catching protrusion caught by or released from at least one of the catching projections, and the second stopper includes a second coupling hole rotatably coupled with the second stopper coupling portion and a second catching protrusion caught by or released from at least one of the catching projections.

5. The refrigerator according to claim 4, wherein on an outer surface of the first coupling hole a first gear portion is provided, on an outer surface of the second coupling hole a second gear portion is provided such that the first gear portion and the second gear portion are interlocked with each other, and when the first stopper rotates on the first coupling hole, the second stopper rotates on the second coupling hole in a direction opposite of a direction in which the first stopper rotates.

6. The refrigerator according to claim 5, wherein a stopper protrusion is disposed at least one of the first stopper and the second stopper adjacent to at least one of the first catching protrusion and the second catching protrusion in such a way as to protrude toward the guide.

7. The refrigerator according to claim 6, wherein the catching portion includes a pair of catching portions, and wherein a rotation guide portion disposed above the plurality of catching projections and configured to guide the first stopper and the second stopper to rotate about the first coupling hole and the second coupling hole in the opposite direction of the direction toward the catching projections.

8. The refrigerator according to claim 7, wherein the fixing rib includes a pair of fixing ribs provided between the first coupling hole and the catching portion adjacent to the first coupling hole and between the second coupling hole and the catching portion adjacent to the second coupling hole, and wherein the stopper protrusion of the stopper guided by the rotation guide and escaped from the catching projection is fixed by the pair of the fixing ribs fixes.

9. The refrigerator according to claim 8, if the door guide moves upward, the guide portion moves upward along the guide rail, and the door guide moved upward is caught by or released from the catching projections so that a position of the door guide is adjusted by the stopper.

10. The refrigerator according to claim 9, wherein if the door guide is moved upward and released from a position adjusted by the plurality of catching projections, the first stopper and the second stopper are rotated in the direction opposite to the direction of the catching projection toward the catching projection about the first coupling hole and the second coupling hole by the rotation guide portion, and the first stopper and the second stopper are prevented from rotating in the direction toward the catching projection about the first coupling hole and the second coupling hole, respectively.

11. The refrigerator according to claim 10, wherein if the door guide is moved downward in a state in which the first stopper and the second stopper are fixed to prevent rotation, the stopper protrusion maintains a fixed state on the fixing rib, and the guide portion moves downward along the guide rail.

12. The refrigerator according to claim 11, wherein if the door guide is moved downward and the stopper protrusion is released from the fixing rib, the first stopper and the second stopper are rotated about the first coupling hole and the second coupling hole in the direction toward the catching projection, respectively and the catching projection is caught in the catching projection.

* * * * *